US011885328B2

(12) United States Patent
Nicholas et al.

(10) Patent No.: US 11,885,328 B2
(45) Date of Patent: Jan. 30, 2024

(54) SCROLL DEVICE WITH AN INTEGRATED COOLING LOOP

(71) Applicant: Air Squared, Inc., Broomfield, CO (US)

(72) Inventors: Nathan D. Nicholas, Westminster, CO (US); Joshua R. Mesward, Arvada, CO (US); John P. D. Wilson, Lakewood, CO (US)

(73) Assignee: Air Squared, Inc., Thornton, CO (US)

( * ) Notice: Subject to any disclaimer, the term of this patent is extended or adjusted under 35 U.S.C. 154(b) by 0 days.

(21) Appl. No.: 17/868,609

(22) Filed: Jul. 19, 2022

(65) Prior Publication Data

US 2023/0020439 A1 Jan. 19, 2023

Related U.S. Application Data

(60) Provisional application No. 63/298,118, filed on Jan. 10, 2022, provisional application No. 63/223,388, filed on Jul. 19, 2021.

(51) Int. Cl.
*F04C 18/02* (2006.01)
*F04C 29/04* (2006.01)

(52) U.S. Cl.
CPC ..... *F04C 18/0215* (2013.01); *F04C 29/04* (2013.01)

(58) Field of Classification Search
CPC .. F04C 18/0215; F04C 18/0261; F04C 29/04; F04C 29/12; F04C 29/02; F01C 18/0215
See application file for complete search history.

(56) References Cited

U.S. PATENT DOCUMENTS

| | | | |
|---|---|---|---|
| 801,182 | A | 10/1905 | Creux |
| 2,079,118 | A | 5/1937 | Hingst |
| 2,330,121 | A | 9/1943 | Heintz |
| 2,475,247 | A | 7/1949 | Mikulasek |
| 2,968,157 | A | 1/1961 | Cronan |

(Continued)

FOREIGN PATENT DOCUMENTS

| | | |
|---|---|---|
| CN | 1314899 | 5/2007 |
| CN | 103790826 | 5/2014 |

(Continued)

OTHER PUBLICATIONS

"Digital Scroll Compressor Technology," Wikipedia, 2010, 3 pages [retrieved online from: en.wikipedia.org/wiki/Digital_Scroll_Compressor_Technology].

(Continued)

*Primary Examiner* — Mickey H France
*Assistant Examiner* — Dapinder Singh
(74) *Attorney, Agent, or Firm* — Sheridan Ross P.C.

(57) ABSTRACT

A scroll device has a fixed scroll, and orbiting scroll, and at least an integrated cooling loop configured to receive coolant to cool the fixed scroll and the orbiting scroll. A flexible conduit is provided that curves radially around an orbital axis of the orbiting scroll to transfer coolant along integrated cooling loop. The integrated cooling loop separates coolant used to cool the fixed scroll and the orbiting scroll from the involutes of the scroll device providing clean operation of the scroll device. The integrated cooling loop may be defined by the flexible conduit, one or more cooling chambers, and/or one or more cooling passageways.

20 Claims, 13 Drawing Sheets

(56) References Cited

U.S. PATENT DOCUMENTS 3,011,694 A 12/1961 Mulhouse et al.
3,262,573 A 7/1966 Schutte
3,470,704 A 10/1969 Kantor
3,600,114 A 8/1971 Miloslav et al.
3,613,368 A 10/1971 Doerner
3,802,809 A 4/1974 Vulliez
3,842,596 A 10/1974 Gray
3,874,827 A 4/1975 Young
3,884,599 A 5/1975 Young et al.
3,924,977 A 12/1975 McCullough
3,986,799 A 10/1976 McCullough
3,986,852 A 10/1976 Doerner et al.
3,994,633 A 11/1976 Shaffer
3,994,635 A 11/1976 Mccullough
3,994,636 A 11/1976 McCullough et al.
3,999,400 A 12/1976 Gray
4,065,279 A 12/1977 McCullough
4,069,673 A 1/1978 Lapeyre
4,082,484 A 4/1978 McCullough
4,121,438 A 10/1978 McCullough
4,129,405 A 12/1978 McCullough
4,157,234 A 6/1979 Weaver et al.
4,160,629 A 7/1979 Hidden et al.
4,178,143 A 12/1979 Thelen et al.
4,192,152 A 3/1980 Armstrong et al.
4,199,308 A 4/1980 McCullough
4,216,661 A 8/1980 Tojo et al.
4,259,043 A 3/1981 Hidden et al.
4,300,875 A 11/1981 Fischer et al.
4,334,840 A 6/1982 Teruyama
4,340,339 A 7/1982 Hiraga et al.
4,368,802 A 1/1983 Grabill et al.
4,382,754 A 5/1983 Shaffer et al.
4,395,205 A 7/1983 McCullough
4,395,885 A 8/1983 Cozby
4,403,494 A 9/1983 McCullough
4,411,605 A 10/1983 Sauls
4,415,317 A 11/1983 Buttersworth
4,416,597 A 11/1983 Eber et al.
4,424,010 A 1/1984 McCullough
4,436,495 A 3/1984 McCullough
4,457,674 A 7/1984 Kawano et al.
4,462,771 A 7/1984 Teegarden
4,463,591 A 8/1984 McCullough
4,472,120 A 9/1984 McCullough
4,475,346 A 10/1984 Young et al.
4,477,238 A 10/1984 Terauchi
4,478,562 A 10/1984 Schippers et al.
4,511,091 A 4/1985 Vasco
4,512,066 A 4/1985 McCullough
4,515,539 A 5/1985 Etsuo
4,673,339 A 6/1987 Hayano et al.
4,718,836 A 1/1988 Pottier et al.
4,722,676 A 2/1988 Sugimoto
4,726,100 A 2/1988 Etemad et al.
4,730,375 A 3/1988 Nakamura et al.
4,732,550 A 3/1988 Suzuki et al.
4,756,675 A 7/1988 Kakuda et al.
4,802,831 A 2/1989 Suefuji et al.
4,832,586 A 5/1989 Emmenthal et al.
4,867,657 A 9/1989 Kotlarek et al.
4,875,839 A 10/1989 Sakata et al.
4,892,469 A 1/1990 McCullough et al.
4,911,621 A 3/1990 Mccullough et al.
4,918,930 A 4/1990 Gaudet et al.
4,927,340 A 5/1990 McCullough
4,990,072 A 2/1991 Guttinger
5,013,226 A 5/1991 Nishida
5,037,280 A 8/1991 Nishida et al.
5,040,956 A 8/1991 Barito et al.
5,044,904 A 9/1991 Richardson, Jr.
5,051,075 A 9/1991 Young
5,051,079 A 9/1991 Richardson, Jr.
5,082,430 A 1/1992 Guttinger
5,099,658 A 3/1992 Utter et al.
5,108,274 A 4/1992 Kakuda et al.
5,127,809 A 7/1992 Amata et al.
5,142,885 A 9/1992 Utter et al.
5,149,255 A 9/1992 Young
5,157,928 A 10/1992 Gaudet et al.
5,160,253 A 11/1992 Okada et al.
5,176,004 A 1/1993 Gaudet
5,214,932 A 6/1993 Abdelmalek
5,217,360 A 6/1993 Kawahara et al.
5,222,882 A 6/1993 McCullough
5,224,849 A 7/1993 Forni
5,228,309 A 7/1993 McCullough
5,232,355 A 8/1993 Fujii et al.
5,242,284 A 9/1993 Mitsunaga et al.
5,247,795 A 9/1993 McCullough
RE34,413 E 10/1993 McCullough
5,256,042 A 10/1993 McCullough et al.
5,258,046 A 11/1993 Haga et al.
5,265,431 A 11/1993 Gaudet et al.
5,286,179 A 2/1994 Forni et al.
5,295,808 A 3/1994 Machida et al.
5,314,316 A 5/1994 Shibamoto et al.
5,328,341 A 7/1994 Forni
5,338,159 A 8/1994 Riffe et al.
5,343,708 A 9/1994 Gaudet et al.
5,354,184 A 10/1994 Forni
5,358,387 A 10/1994 Suzuki et al.
5,397,223 A 3/1995 Spinler et al.
5,417,554 A 5/1995 Kietzman et al.
5,443,368 A 8/1995 Weeks et al.
5,449,279 A 9/1995 Hill et al.
5,450,316 A 9/1995 Gaudet et al.
5,462,419 A 10/1995 Hill et al.
5,466,134 A 11/1995 Shaffer et al.
5,496,161 A 3/1996 Machida et al.
5,609,478 A 3/1997 Utter et al.
5,616,015 A 4/1997 Liepert
5,616,016 A 4/1997 Hill et al.
5,632,612 A 5/1997 Shaffer
5,632,613 A 5/1997 Shin et al.
5,637,942 A 6/1997 Forni
5,640,854 A 6/1997 Fogt et al.
5,720,602 A 2/1998 Hill et al.
5,746,719 A 5/1998 Ferra et al.
5,752,816 A 5/1998 Shaffer
5,759,020 A 6/1998 Shaffer
5,800,140 A 9/1998 Forni
5,803,723 A 9/1998 Suefuji et al.
5,836,752 A 11/1998 Calhoun et al.
5,842,843 A 12/1998 Haga
5,855,473 A 1/1999 Liepert
5,857,844 A 1/1999 Lifson et al.
5,873,711 A 2/1999 Lifson
5,938,419 A 8/1999 Honma et al.
5,951,268 A 9/1999 Pottier et al.
5,961,297 A 10/1999 Haga et al.
5,987,894 A 11/1999 Claudet
6,008,557 A 12/1999 Dornhoefer et al.
6,022,195 A 2/2000 Gaudet et al.
6,050,792 A 4/2000 Shaffer
6,068,459 A 5/2000 Clarke et al.
6,074,185 A 6/2000 Protos
6,098,048 A 8/2000 Dashefsky et al.
6,129,530 A 10/2000 Shaffer
6,179,590 B1 1/2001 Honma et al.
6,186,755 B1 2/2001 Haga
6,190,145 B1 2/2001 Fujioka et al.
6,193,487 B1 2/2001 Ni
6,213,970 B1 4/2001 Nelson et al.
6,283,737 B1 9/2001 Kazikis et al.
6,318,093 B2 11/2001 Gaudet et al.
6,328,545 B1 12/2001 Kazakis et al.
6,379,134 B2 * 4/2002 Iizuka ..... F04C 18/0238 418/101
6,434,943 B1 8/2002 Garris
6,439,864 B1 8/2002 Shaffer
6,460,351 B2 10/2002 Gaudet et al.
6,461,113 B1 10/2002 Gaudet et al.
6,464,467 B2 10/2002 Sullivan et al.

(56) References Cited

U.S. PATENT DOCUMENTS

| | | | |
|---|---|---|---|
| 6,511,308 | B2 | 1/2003 | Shaffer |
| 6,623,445 | B1 | 9/2003 | Nelson et al. |
| 6,644,946 | B2 | 11/2003 | Nakane et al. |
| 6,663,364 | B2 | 12/2003 | Okada et al. |
| 6,712,589 | B2 | 3/2004 | Mori et al. |
| 6,736,622 | B1 | 5/2004 | Bush et al. |
| 6,755,028 | B2 | 6/2004 | Gaudet et al. |
| 6,902,378 | B2 | 6/2005 | Gaudet et al. |
| 6,905,320 | B2 | 6/2005 | Satoh et al. |
| 6,922,999 | B2 | 8/2005 | Kimura et al. |
| 7,111,467 | B2 | 9/2006 | Apparao et al. |
| 7,124,585 | B2 | 10/2006 | Kim et al. |
| 7,144,383 | B2 | 12/2006 | Arnett et al. |
| 7,181,928 | B2 | 2/2007 | de Larminat |
| 7,201,568 | B2 | 4/2007 | Sakamoto et al. |
| 7,234,310 | B2 | 6/2007 | Flynn et al. |
| 7,249,459 | B2 | 7/2007 | Hisanaga et al. |
| 7,297,133 | B2 | 11/2007 | Nelson et al. |
| 7,306,439 | B2 | 12/2007 | Unami et al. |
| 7,314,358 | B2 | 1/2008 | Tsuchiya |
| 7,329,108 | B2 | 2/2008 | Tscuchiya et al. |
| 7,439,702 | B2 | 10/2008 | Smith et al. |
| 7,458,152 | B2 | 12/2008 | Sato |
| 7,458,414 | B2 | 12/2008 | Simon |
| 7,836,696 | B2 | 11/2010 | Uno et al. |
| 7,861,541 | B2 | 1/2011 | Dieckmann et al. |
| 7,906,016 | B2 | 3/2011 | Weber et al. |
| 7,942,655 | B2 | 5/2011 | Shaffer |
| 7,980,078 | B2 | 7/2011 | McCutchen et al. |
| 8,007,260 | B2 | 8/2011 | Yanagisawa |
| 8,087,260 | B2 | 1/2012 | Ogata et al. |
| 8,186,980 | B2 | 5/2012 | Komai et al. |
| 8,328,544 | B2 | 12/2012 | Iwano et al. |
| 8,484,974 | B1 | 7/2013 | Monson et al. |
| 8,523,544 | B2 | 9/2013 | Shaffer |
| 8,668,479 | B2 | 3/2014 | Shaffer |
| 8,674,525 | B2 | 3/2014 | Van Den Bossche et al. |
| 8,858,203 | B2 | 10/2014 | Kanizumi et al. |
| 9,022,758 | B2 | 5/2015 | Roof et al. |
| 9,028,230 | B2 | 5/2015 | Shaffer |
| 9,074,598 | B2 | 7/2015 | Shaffer et al. |
| 9,115,719 | B2 | 8/2015 | Sadakata et al. |
| 9,657,733 | B2 | 5/2017 | Chadwick et al. |
| 9,784,139 | B2 | 10/2017 | Shaffer et al. |
| 9,885,358 | B2 | 2/2018 | Shaffer |
| 10,221,852 | B2 * | 3/2019 | Shaffer ..... F04C 18/0215 |
| 10,400,771 | B2 | 9/2019 | Valdez et al. |
| 10,508,543 | B2 | 12/2019 | Shaffer |
| 10,519,815 | B2 | 12/2019 | Shaffer et al. |
| 10,683,865 | B2 | 6/2020 | Shaffer et al. |
| 10,774,690 | B2 | 9/2020 | Shaffer et al. |
| 10,865,793 | B2 | 12/2020 | Shaffer et al. |
| 10,890,187 | B2 | 1/2021 | Fukuhara et al. |
| 11,047,389 | B2 | 6/2021 | Shaffer et al. |
| 11,067,080 | B2 | 7/2021 | Mesward et al. |
| 11,454,241 | B2 | 9/2022 | Shaffer et al. |
| 11,473,572 | B2 | 10/2022 | Wilson et al. |
| 11,530,703 | B2 | 12/2022 | Nicholas et al. |
| 2001/0012485 | A1 | 8/2001 | Gaudet et al. |
| 2001/0038800 | A1 | 11/2001 | Kimura et al. |
| 2001/0043878 | A1 | 11/2001 | Sullivan et al. |
| 2002/0011332 | A1 | 1/2002 | Oh et al. |
| 2002/0039534 | A1 | 4/2002 | Moroi et al. |
| 2002/0071779 | A1 | 6/2002 | Moroi et al. |
| 2002/0094277 | A1 | 7/2002 | Gaudet et al. |
| 2002/0104320 | A1 | 8/2002 | Gaudet et al. |
| 2003/0017070 | A1 | 1/2003 | Moroi et al. |
| 2003/0026721 | A1 | 2/2003 | Moroi et al. |
| 2003/0051487 | A1 | 3/2003 | Gaudet et al. |
| 2003/0053922 | A1 | 3/2003 | Satoh et al. |
| 2003/0138339 | A1 | 7/2003 | Scancarello |
| 2003/0223898 | A1 | 12/2003 | Fujioka et al. |
| 2004/0020206 | A1 | 2/2004 | Sullivan et al. |
| 2004/0184940 | A1 | 9/2004 | Nakane et al. |
| 2004/0194477 | A1 | 10/2004 | Gaudet et al. |
| 2004/0241030 | A1 | 12/2004 | Matsushima |
| 2004/0255591 | A1 | 12/2004 | Hisanga et al. |
| 2005/0025651 | A1 | 2/2005 | Sowa et al. |
| 2005/0031469 | A1 | 2/2005 | Yanagisawa et al. |
| 2005/0081536 | A1 | 4/2005 | Gaudet et al. |
| 2005/0169788 | A1 | 8/2005 | Komai et al. |
| 2005/0196284 | A1 | 9/2005 | Gaudet et al. |
| 2005/0220649 | A1 | 10/2005 | Sato |
| 2006/0016184 | A1 | 1/2006 | Simon |
| 2006/0045760 | A1 | 3/2006 | Haller et al. |
| 2006/0045783 | A1 | 3/2006 | Yanagisawa et al. |
| 2006/0130495 | A1 | 6/2006 | Dieckmann et al. |
| 2006/0216180 | A1 | 9/2006 | Yanagisawa et al. |
| 2007/0071626 | A1 | 3/2007 | Tsuchiya et al. |
| 2007/0098511 | A1 | 5/2007 | Kikkawa et al. |
| 2007/0104602 | A1 | 5/2007 | Ishikawa et al. |
| 2007/0108934 | A1 | 5/2007 | Smith et al. |
| 2007/0172373 | A1 | 7/2007 | Ni |
| 2007/0231174 | A1 | 10/2007 | Ishizuki |
| 2007/0269327 | A1 | 11/2007 | Qian |
| 2008/0159888 | A1 | 7/2008 | Nakayama et al. |
| 2008/0193311 | A1 | 8/2008 | Helies |
| 2008/0206083 | A1 | 8/2008 | Suefuji et al. |
| 2009/0148327 | A1 | 6/2009 | Carter et al. |
| 2009/0246055 | A1 | 10/2009 | Stehouwer et al. |
| 2009/0304536 | A1 | 12/2009 | Egawa et al. |
| 2010/0044320 | A1 | 2/2010 | Weber et al. |
| 2010/0111740 | A1 | 5/2010 | Ni |
| 2010/0254835 | A1 | 10/2010 | Kane et al. |
| 2010/0287954 | A1 | 11/2010 | Harman et al. |
| 2011/0129362 | A1 | 6/2011 | Kameya et al. |
| 2012/0134862 | A1 | 5/2012 | Hockliffe et al. |
| 2012/0240847 | A1 | 9/2012 | Neufelder et al. |
| 2013/0149179 | A1 | 6/2013 | Sato et al. |
| 2013/0207396 | A1 | 8/2013 | Tsuboi |
| 2013/0232975 | A1 | 9/2013 | Shaffer et al. |
| 2014/0023540 | A1 | 1/2014 | Heidecker et al. |
| 2014/0260364 | A1 | 9/2014 | Litch |
| 2017/0045046 | A1 | 2/2017 | Afshari |
| 2017/0067469 | A1 | 3/2017 | Malvasi et al. |
| 2017/0074265 | A1 | 3/2017 | Asami et al. |
| 2017/0284284 | A1 | 10/2017 | Takamiya |
| 2017/0306956 | A1 | 10/2017 | Monet |
| 2017/0321699 | A1 | 11/2017 | Kawano et al. |
| 2018/0163726 | A1 * | 6/2018 | Shaffer ..... F04C 27/00 |
| 2019/0277289 | A1 | 9/2019 | Yoo et al. |
| 2019/0293070 | A1 | 9/2019 | Crum et al. |
| 2019/0338779 | A1 * | 11/2019 | Shaffer ..... F01C 1/0223 |
| 2019/0353162 | A1 | 11/2019 | Ishii et al. |
| 2020/0025199 | A1 | 1/2020 | Wilson et al. |
| 2020/0040892 | A1 | 2/2020 | Dieckmann et al. |
| 2020/0063735 | A1 | 2/2020 | Yamashita et al. |
| 2021/0071669 | A1 | 3/2021 | Shaffer et al. |
| 2022/0170462 | A1 | 6/2022 | Nicholas et al. |
| 2022/0268281 | A1 | 8/2022 | Nicholas |

FOREIGN PATENT DOCUMENTS

| | | |
|---|---|---|
| CN | 104235018 | 12/2014 |
| CN | 104632636 | 5/2015 |
| CN | 105402134 | 3/2016 |
| CN | 111765078 | 10/2020 |
| DE | 460936 | 6/1928 |
| DE | 19957425 | 8/2000 |
| EP | 0513824 | 11/1992 |
| EP | 0780576 | 6/1997 |
| EP | 1464838 | 10/2004 |
| EP | 3239526 | 11/2017 |
| GB | 0513827 | 10/1939 |
| GB | 2002455 | 2/1979 |
| GB | 1575684 | 9/1980 |
| JP | S56-019369 | 2/1981 |
| JP | S57-171002 | 10/1982 |
| JP | S60-135691 | 7/1985 |
| JP | S63-173870 | 7/1988 |
| JP | H02-275083 | 11/1990 |
| JP | H03-185287 | 8/1991 |
| JP | H05-157076 | 6/1993 |
| JP | H07-109981 | 4/1995 |

(56) References Cited

FOREIGN PATENT DOCUMENTS

| | | |
|---|---|---|
| JP | H07-324688 | 12/1995 |
| JP | H08-261182 | 10/1996 |
| JP | 2000-213475 | 8/2000 |
| JP | 2002-13493 | 1/2002 |
| JP | 2002-227779 | 8/2002 |
| JP | 2003-343459 | 12/2003 |
| JP | 2011-012629 | 1/2011 |
| WO | WO 2004/008829 | 1/2004 |
| WO | WO 2009/050126 | 4/2009 |
| WO | WO 2013/121900 | 8/2013 |
| WO | WO 2015/164453 | 10/2015 |
| WO | WO 2017/089745 | 6/2017 |

OTHER PUBLICATIONS

"Heat Pump and Refrigeration Cycle," Wikipedia, last updated May 10, 2013, 4 pages [retrieved online from: en.wikipedia.org/wiki/Heat_pump_and_refrigeration_cycle].
"Involute," Wikipedia, last modified Jun. 2, 2012, 5 pages [retrieved online from: en.wikipedia.org/wiki/Involute].
"Oldham Coupler," Wikipedia, last modified, Feb. 9, 2010, 2 pages [retrieved online from: en.wikipedia.org/wiki/Oldham_coupler].
"Operating Manual: OM WGZC-2 Water-Cooled Scroll Compressor Chillers," McQuay International, 2010, 102 pages.
"Organic Rankine Cycle," Wikipedia, last modified May 19, 2013, 4 pages [retrieved online from: en.wikipedia.org/wiki/Organic_Rankine_Cycle].
"R410A // Hermetic Scroll Compressors," Bitzer, 2016, 12 pages.
"Rankine Cycle," Wikipedia, last modified Apr. 29, 2013, 4 pages [retrieved online from: en.wikipedia.org/wiki/Rankine_cycle].
"Refrigeration Technologies: scroll-compressor chillers," Misto, last modified Jan. 2013, 7 pages.
"Scroll Compressor," Wikipedia, last modified Apr. 24, 2013, 3 pages [retrieved online from: en.wikipedia.org/wiki/Scroll_compressor].
"Thrust Bearing," Wikipedia, last modified Dec. 19, 2012, 2 pages [retrieved online from: en.wikipedia.org/wiki/Thrust_bearing].
International Search Report and Written Opinion for International (PCT) Patent Application No. PCT/US2018/064427, dated Feb. 5, 2019 14 pages.
International Preliminary Report on Patentability for International (PCT) Patent Application No. PCT/US2018/064427, dated Nov. 19, 2020 8 pages.
Official Action (English Translation) for China Patent Application No. 201980029887.8, dated Dec. 3, 2021 10 pages.
Notice of Allowance with English Translation for China Patent Application No. 201980029887.8, dated Jun. 28, 2022 6 pages.
Extended European Search Report for European Patent Application No. 18917539.1, dated Jan. 4, 2022 7 pages.
Official Action with English Translation for Japan Patent Application No. 2020-561761, dated Sep. 21, 2021 6 pages.
Decision to Grant for Japan Patent Application No. 2020-561761, dated Feb. 15, 2022 6 pages.
Official Action for U.S. Appl. No. 16/213, 111, dated Sep. 30, 2020 22 pages.
Official Action for U.S. Appl. No. 16/213,111, dated May 4, 2021 25 pages.
Official Action for U.S. Appl. No. 16/213,111, dated Dec. 8, 2021 23 pages.
Notice of Allowance for U.S. Appl. No. 16/213,111, dated Apr. 26, 2022 10 pages.
Official Action for U.S. Appl. No. 16/912,537, dated Jan. 26, 2022 15 pages.
Notice of Allowance for U.S. Appl. No. 16/912,537, dated May 25, 2022 8 pages.
Official Action for U.S. Appl. No. 17/679,936, dated Oct. 27, 2022 16 pages.

* cited by examiner

SCROLL DEVICE WITH AN INTEGRATED COOLING LOOP

CROSS-REFERENCE TO RELATED APPLICATIONS

This application claims the benefits of U.S. Provisional Patent Application No. 63/298,118, filed Jan. 10, 2022 and entitled "SCROLL DEVICE WITH AN INTEGRATED COOLING LOOP" and U.S. Provisional Patent Application No. 63/223,388, filed Jul. 19, 2021 and entitled "SCROLL DEVICE WITH AN INTEGRATED COOLING LOOP," the entireties of which are hereby incorporated by reference herein for all purposes.

FIELD

The present disclosure relates to scroll devices such as compressors, expanders, or vacuum pumps, and more particularly to scroll devices with liquid cooling.

Scroll devices have been used as compressors, expanders, pumps, and vacuum pumps for many years. In general, they have been limited to a single stage of compression (or expansion) due to the complexity of two or more stages. In a single stage scroll vacuum pump, a spiral involute or scroll orbits within a fixed spiral or scroll upon a stationery plate. A motor turns a shaft that causes the orbiting scroll to orbit eccentrically within the fixed scroll. The eccentric orbit forces a gas through and out of pockets created between the orbiting scroll and the fixed scroll, thus creating a vacuum in a container in fluid communication with the scroll device. An expander operates with the same principle, but with expanding gas causing the orbiting scroll to orbit in reverse and, in some embodiments, to drive a generator. When referring to compressors, it is understood that a vacuum pump can be substituted for a compressor and that an expander can be an alternate usage when the scrolls operate in reverse from an expanding gas.

Scroll type compressors and vacuum pumps generate heat as part of the compression or pumping process. The higher the pressure ratio, the higher the temperature of the compressed fluid. In order to keep the compressor hardware to a reasonable temperature, the compressor must be cooled or damage to the hardware may occur. In some cases, cooling is accomplished by blowing cool ambient air over the compressor components. On the other hand, scroll type expanders experience a drop in temperature due to the expansion of the working fluid, which reduces overall power output. As a result, scroll type expanders may be insulated to limit the temperature drop and corresponding decrease in power output.

Conventional designs include oil-free reciprocating type pump compressors. These compressors are air cooled and cannot operate continuously. As such, these compressors are typically designed for intermittent use to manage temperature.

SUMMARY

Existing scroll devices suffer from various drawbacks. In some cases, such as in tight installations or where there is too much heat to be dissipated, air cooling of a scroll device may not be effective. In semi-hermetic or hermetic applications, air cooling of a scroll device may not be an option. The use of a liquid to cool a scroll device may be beneficial because liquid has a much higher heat transfer coefficient than air. In the case of scroll expanders, the use of a liquid to heat the scroll expander may be beneficial for the same reason.

In at least one embodiment of the present disclosure a scroll device comprises a cooling fluid reservoir; a fixed scroll comprising a first involute; an orbiting scroll comprising a body, a second involute extending from the body, and a set of cross holes extending through the body from a first end of the body to a second end of the body, the orbiting scroll mounted to the fixed scroll via a mechanical coupling, the orbiting scroll configured to orbit relative to the fixed scroll around an orbital axis; and an integrated cooling loop comprising a cooling fluid flow path running from the cooling fluid reservoir to the set of cross holes and back to the cooling fluid reservoir, wherein cooling fluid routes along the cooling fluid flow path.

Any of the aspects herein, wherein the set of cross holes are through-holes extending linearly from the first end of the body through the second end of the body.

Any of the aspects herein, wherein the set of cross holes extend parallel to each other.

Any of the aspects herein, wherein the cooling fluid reservoir is disposed on the fixed scroll.

Any of the aspects herein, further comprising at least one flexible conduit coupled to the cooling fluid reservoir and the set of cross holes, the at least one flexible conduit configured to route the cooling fluid between the cooling fluid reservoir and the set of cross holes.

Any of the aspects herein, wherein the at least one flexible conduit curves around the orbital axis from the first end of the body to the second end of the body.

Any of the aspects herein, further comprising an integrated aftercooler that partially encloses the cooling fluid reservoir, wherein the integrated aftercooler is configured to cool a discharge fluid discharged from the scroll device.

Any of the aspects herein, wherein the set of cross holes comprises four cross holes.

Any of the aspects herein, further comprising a cross hole inlet disposed near the first end and a cross hole outlet disposed near the second end, each of the cross hole inlet and the cross hole outlet in fluid communication with the at least one flexible conduit.

Any of the aspects herein, further comprising a heatsink attached to the fixed scroll and comprising a set of cooling fluid fins disposed on a first side and a set of air fins disposed on a second side opposite the first side, wherein the set of cooling fluid fins extend into the cooling fluid reservoir and in contact with the cooling fluid routing along the cooling fluid flow path, wherein the cooling fluid reservoir is sealed by the first side of the heatsink preventing cooling fluid from reaching the set of air fins, and wherein a heat conduction path runs from the set of cooling fluid fins disposed in the cooling fluid reservoir through the heatsink to the set of air fins disposed external to the cooling fluid reservoir.

A scroll device according to at least one embodiment of the present disclosure comprises: a fixed scroll comprising a first involute and a cooling chamber; an orbiting scroll comprising a body, a second involute extending from the body, and one or more passageways extending through the body from a first end of the body to a second end of the body, the orbiting scroll mounted to the fixed scroll via a mechanical coupling, the orbiting scroll configured to orbit relative to the fixed scroll around an orbital axis; and an integrated cooling loop comprising a cooling fluid flow path running from the cooling chamber to the one or more passageways and back to the cooling chamber, wherein cooling fluid routes along the cooling fluid flow path.

Any of the aspects herein, wherein the one or more passageways comprises a set of cross holes.

Any of the aspects herein, wherein the set of cross holes are through-holes extending linearly from the first end of the body through the second end of the body.

Any of the aspects herein, wherein the set of cross holes extend parallel to each other.

Any of the aspects herein, wherein the set of cross holes comprises four cross holes.

Any of the aspects herein, further comprising an integrated aftercooler that partially encloses the cooling chamber, wherein the integrated aftercooler is configured to cool a discharge fluid discharged from the scroll device.

Any of the aspects herein, further comprising at least one flexible conduit coupled to the cooling chamber and the one or more passageways, the at least one flexible conduit configured to route the cooling fluid between the cooling chamber and the one or more passageways.

Any of the aspects herein, wherein the at least one flexible conduit curves radially around the orbital axis from the first end of the body to the second end of the body.

Any of the aspects herein, further comprising a heatsink attached to the fixed scroll and comprising a set of cooling fluid fins disposed on a first side and a set of air fins disposed on a second side opposite the first side, wherein the set of cooling fluid fins extend into the cooling chamber and in contact with the cooling fluid routing along the cooling fluid flow path, wherein the cooling chamber is sealed by the first side of the heatsink preventing cooling fluid from reaching the set of air fins, and wherein a heat conduction path runs from the set of cooling fluid fins disposed in the cooling fluid chamber through the heatsink to the set of air fins disposed external to the cooling chamber.

A scroll device according to at least one embodiment of the present disclosure comprises: a fixed scroll comprising a first involute and a cooling fluid reservoir disposed on a side of the fixed scroll opposite the first involute; an orbiting scroll comprising a second involute and a set of cross holes extending from a first end to a second end, the orbiting scroll mounted to the fixed scroll via a mechanical coupling, the orbiting scroll configured to orbit relative to the fixed scroll around an orbital axis; an integrated cooling loop comprising a cooling fluid flow path running from the cooling fluid reservoir to the set of cross holes and back to the cooling fluid reservoir, wherein cooling fluid routes along the cooling fluid flow path; and a heatsink attached to the fixed scroll and comprising a set of cooling fluid fins disposed on a first side and a set of air fins disposed on a second side opposite the first side, wherein the set of cooling fluid fins extend into the cooling fluid reservoir and in contact with the cooling fluid routing along the cooling fluid flow path, wherein the cooling fluid reservoir is sealed by the first side of the heatsink preventing cooling fluid from reaching the set of air fins, and wherein a heat conduction path runs from the set of cooling fluid fins disposed in the cooling fluid chamber through the heatsink to the set of air fins disposed external to the cooling fluid chamber.

Any aspect in combination with any one or more other aspects.

Any one or more of the features disclosed herein.

Any one or more of the features as substantially disclosed herein.

Any one or more of the features as substantially disclosed herein in combination with any one or more other features as substantially disclosed herein.

Any one of the aspects/features/embodiments in combination with any one or more other aspects/features/embodiments.

Use of any one or more of the aspects or features as disclosed herein.

It is to be appreciated that any feature described herein can be claimed in combination with any other feature(s) as described herein, regardless of whether the features come from the same described embodiment.

The term "scroll device" as used herein refers to scroll compressors, scroll vacuum pumps, and similar mechanical devices. The term "scroll device" as used herein also encompasses scroll expanders, with the understanding that scroll expanders absorb heat rather than generating heat, such that the various aspects and elements described herein for cooling scroll devices other than scroll expanders may be used for heating scroll expanders (e.g., using warm liquid).

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$—$X_n$, $Y_1$—$Y_m$, and $Z_1$—$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Before any embodiments of the disclosure are explained in detail, it is to be understood that the disclosure is not limited in its application to the details of construction and the arrangement of components set forth in the following description or illustrated in the figures. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

In some embodiments, the present disclosure provides a scroll device that utilizes a self-contained liquid cooling loop to improve heat transfer from the orbiting scroll. Traditionally, cooling the orbiting scroll is difficult due to limitations with cooling fins and air flow. Liquid cooling is an effective method of removing thermal energy away from the orbiting scroll. Using the same cooling fluid to cool the fixed scroll and orbiting scroll also reduces the temperature difference between the two scrolls. Operation with scrolls at differing temperatures can cause potential issues from thermal expansion (e.g., due to a mismatch in thermal expansion between one scroll and the other, etc.).

Figure 1:
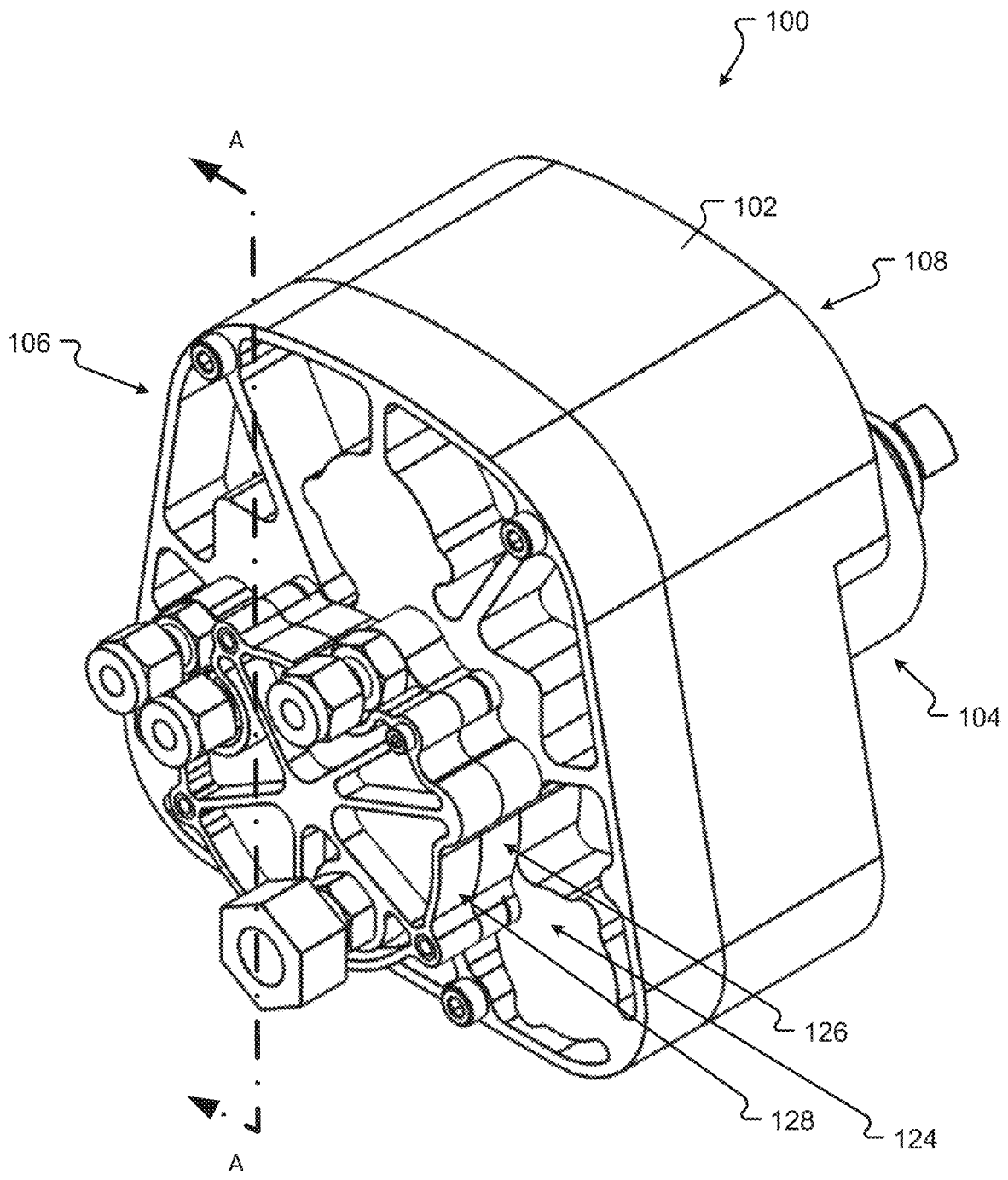
FIG. 1 is a perspective view of a scroll device according to at least one embodiment of the present disclosure.
Figure 2:
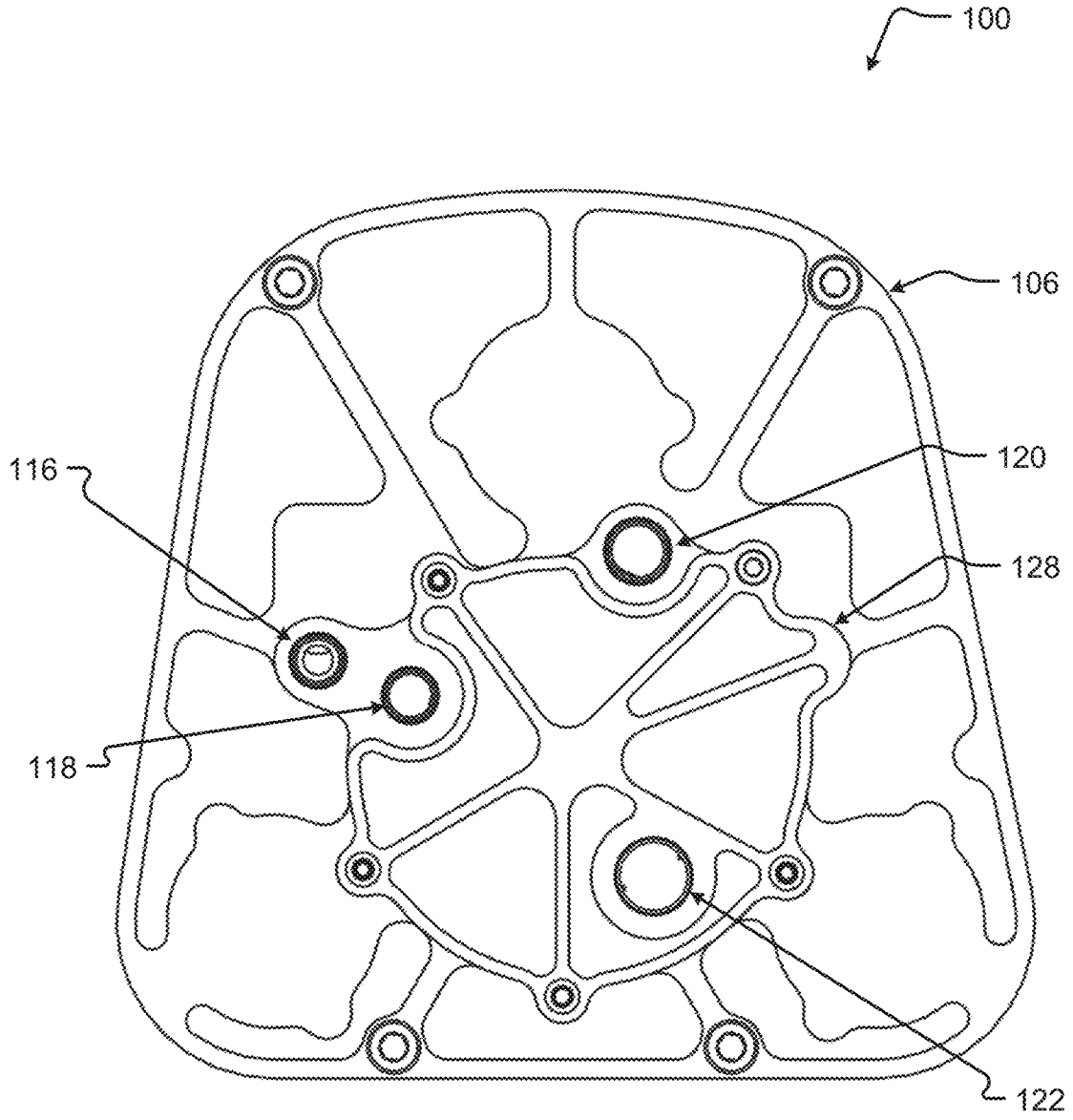
FIG. 2 is a front elevation view of a scroll device according to at least one embodiment of the present disclosure.

Turning now to FIGS. 1 and 2, a scroll device 100 according to embodiments of the present disclosure is shown. The scroll device 100 comprises a housing 102 and a motor 104. In some embodiments, the motor 104 may be mounted, fastened, or otherwise attached to the housing 102. The scroll device 100 comprises a fixed scroll 106 mated to an orbiting scroll 108. The scroll device 100 also includes three idler shafts 110, 112, 114 (visible in FIG. 5) being spaced approximately 120° apart. It will be appreciated that in some embodiments, the scroll device 100 may have more than or fewer than three idler shafts and the idler shafts may be spaced apart from one another at any combination of angles. The fixed scroll 106 also has a first inlet 116, a first outlet 118, a second inlet 120, and a second outlet 122, as shown in FIG. 2. The first inlet 116 allows a cooling fluid such as, for example, a liquid (not shown) to be directed into, or enter, the scroll device 100 and into a cooling path and the first outlet 118 allows the cooling fluid to exit the cooling path and the scroll device 100. In some embodiments, the cooling fluid may be supplied by a cooling fluid source to the first inlet 116 and the cooling fluid may be received into the cooling fluid source (or a separate cooling fluid storage) from the first outlet 118. It will be appreciated that in other embodiments, the cooling path may be a closed loop within the scroll device 100 and the first inlet 116 and the first outlet 118 may be closed once cooling fluid is delivered to the scroll device 100.

The second inlet 120 may receive a working fluid and the second outlet 122 may discharge the working fluid. The scroll device 100 may comprise an integrated aftercooler 124 comprising an aftercooler plate 126 and an aftercooler cover 128. The integrated aftercooler 124 may be configured to provide cooling or heating to the working fluid after the working fluid has been compressed or expanded, as will be described in more detail in conjunction with FIG. 9. It will be appreciated that in some embodiments, the scroll device 100 may not include the integrated aftercooler 124.

Figure 3:
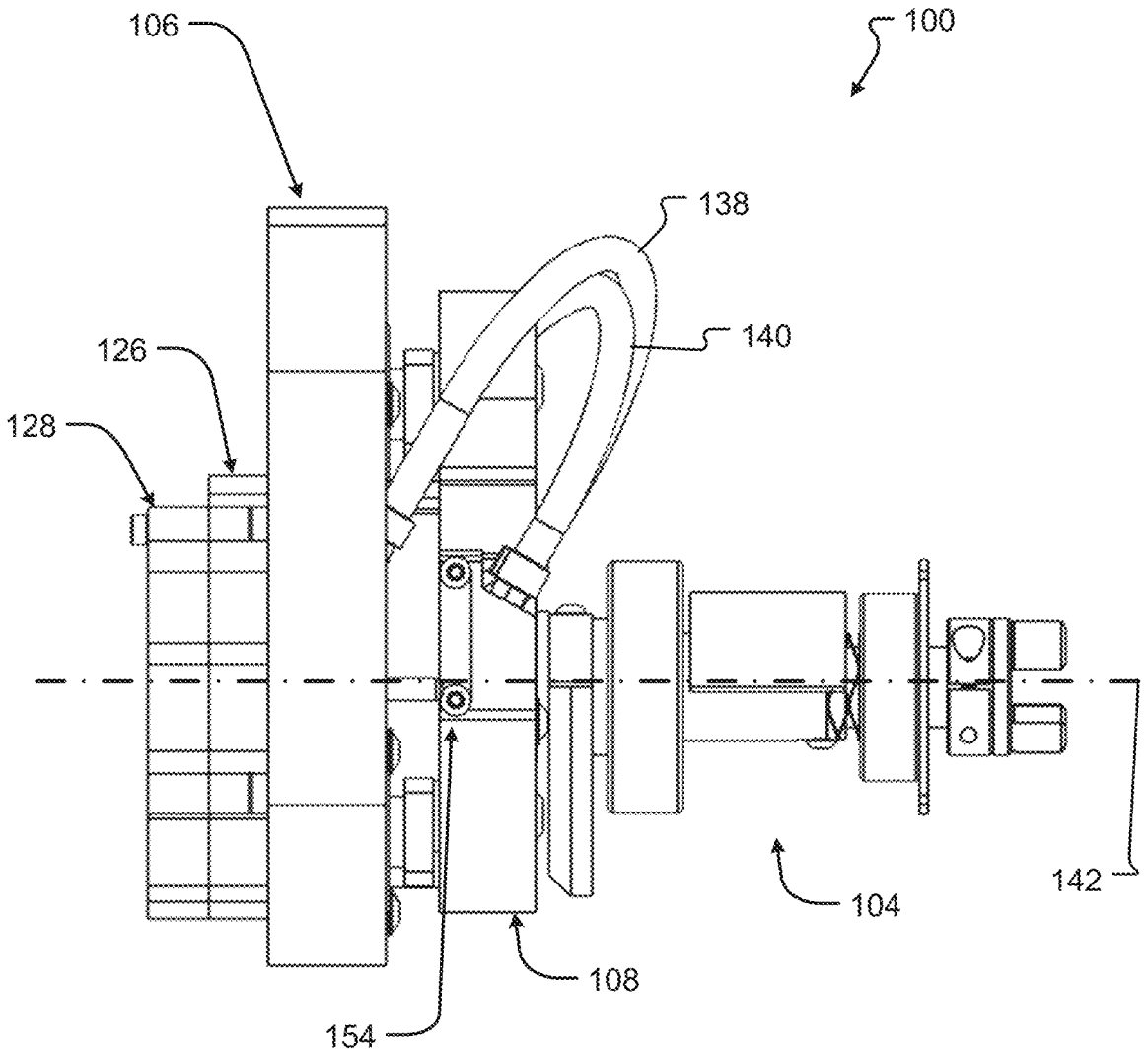
FIG. 3 is a side elevation view of a scroll device with a housing removed according to at least one embodiment of the present disclosure.

Turning to FIG. 3, a side elevation view of the scroll device 100 without the housing 102 is shown. The fixed scroll 106 is operatively coupled, or mated, to the orbiting scroll 108, as described above. The orbiting scroll 108 is driven by a crankshaft 130 (visible in FIG. 9) connected to the motor 104 and the motor 104 is used to drive the crankshaft 130. In some embodiments, the motor 104 may be an electric motor. The crankshaft 130 and the motor 104 are mounted in the housing 102. An opposite end of the crankshaft 130 engages the crankshaft bearing 132 (visible in FIG. 9). The crankshaft 130 is eccentric, which allows the crankshaft 130 to drive the orbiting scroll 108 (via the crankshaft bearing 132) in an orbiting motion relative to the fixed scroll 106.

Figure 9:
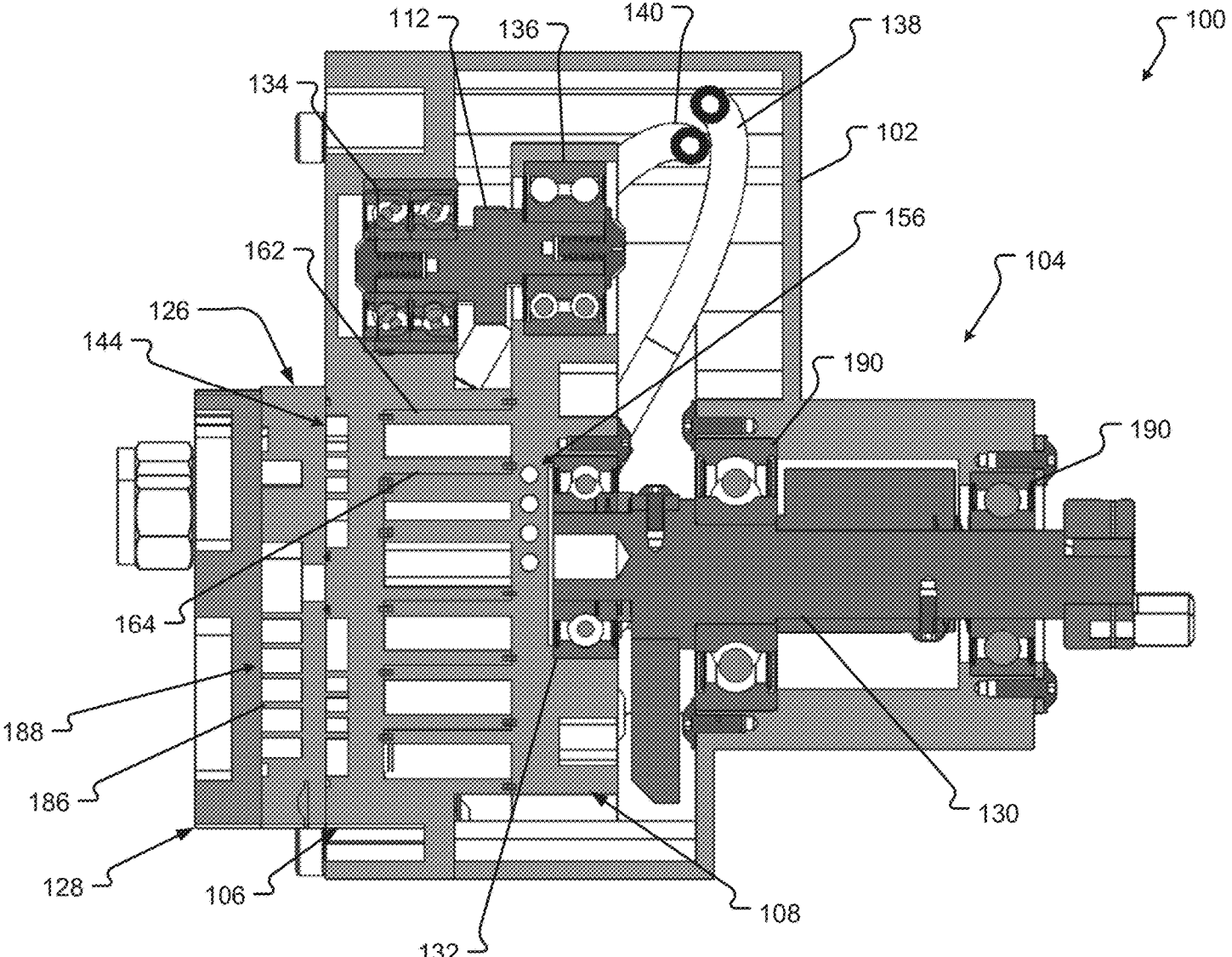
FIG. 9 is a cross-sectional side elevation view of the scroll device taken along line A-A shown in FIG. 1 according to at least one embodiment of the present disclosure.

The orbiting scroll 108 has a first involute 162 (shown in FIGS. 6 and 9) and the fixed scroll 106 has a second involute 164 (shown in FIG. 9). In order to balance the rotary motion of the orbiting scroll 108, a pair of balance weights may be positioned co-axially with the first involute to dynamically balance the orbiting scroll 108. Also, a pair of counterweights may be positioned on the crankshaft 130 to dynamically balance the orbiting scroll 108. The orbiting scroll 108 is coupled to the crankshaft 130 that moves or orbits the orbiting scroll 108 eccentrically, following a fixed path with respect to the fixed scroll 106, creating a series of crescent-shaped pockets between the two scrolls. In the case of a scroll compressor, during operation the working fluid moves from the periphery (inlet) towards the center (discharge) through increasingly smaller pockets, generating compression. Similar principles apply for a scroll vacuum pump and a scroll expander.

The idler shafts 110, 112, 114 are supported by front bearings 134 in the orbiting scroll 108 and the rear bearings 136 in the fixed scroll 106 (see, e.g., FIG. 9). A center line of each of the idler shafts 110, 112, 114 is offset from a center line of the crankshaft 130. To seal any working fluid within the crankshaft 130, a labyrinth seal may be used. The labyrinth seal may be positioned between the bearings or after the rear bearing. It will be appreciated that in other embodiments any seal may be used to seal working fluid within the crankshaft.

As shown, the scroll device 100 comprises flexible conduits 138 and 140 for routing cooling fluid between or among one or more cooling fluid flow paths of the scroll device 100, as will be described in more detail in conjunction with FIGS. 4-9. It will be appreciated that the scroll device 100 may not include the flexible conduits 138, 140 or may include one flexible conduit, two flexible conduits, or more than two flexible conduits. The flexible conduit 138, 140 may curve (e.g., radially) around an orbital axis 142 (shown in FIG. 3) from a first side to a second side opposite the first side.

Figure 4:
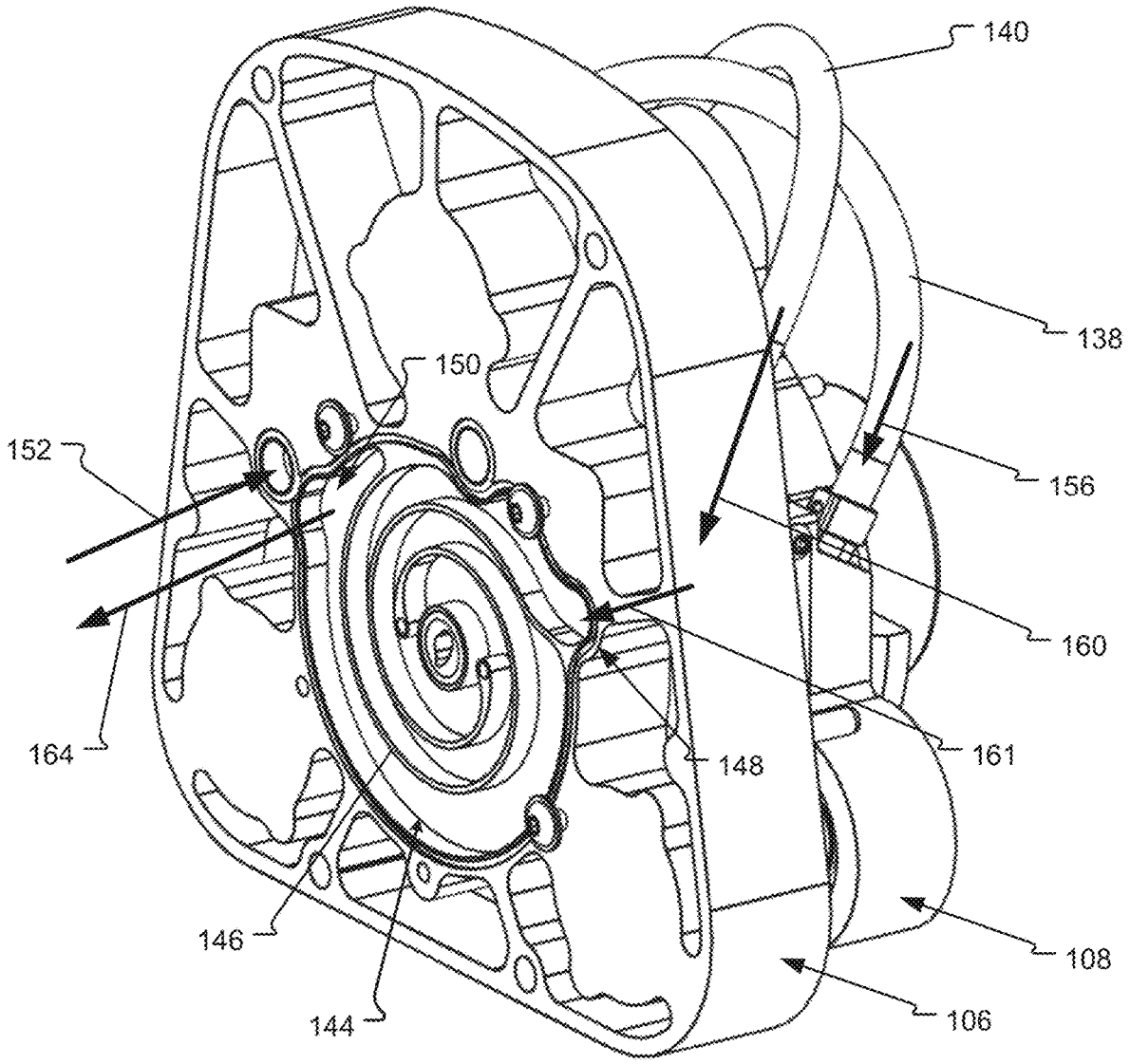
FIG. 4 is a front perspective view of a fixed scroll and an orbiting scroll according to at least one embodiment of the present disclosure.
Figure 5:
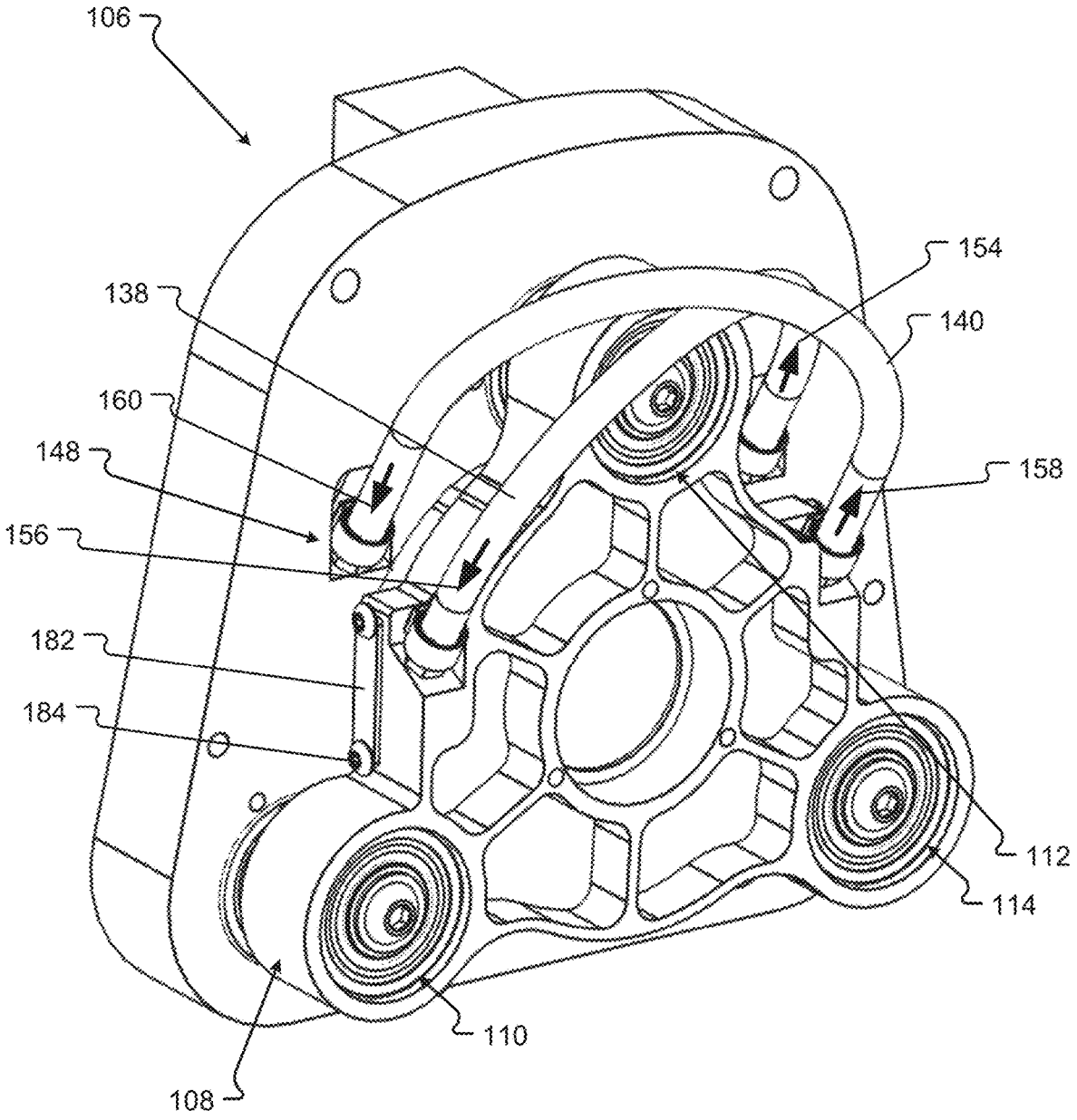
FIG. 5 is a rear perspective view of an orbiting scroll and a fixed scroll according to at least one embodiment of the present disclosure.

Turning to FIGS. 4 and 5, a front perspective view of the fixed scroll 106, the flexible conduits 138, 140, and the orbiting scroll 108 and a rear perspective view of the flexible conduits 138, 140 and the orbiting scroll 108 are respectively shown to illustrate an example cooling fluid flow path. As shown in FIG. 4, the fixed scroll 106 may comprise a cooling chamber 144 having one or more walls 146 defining a fixed scroll cooling path. The cooling chamber 144 may also comprise a cooling chamber inlet 148 through which cooling fluid may be received from the flexible conduit 140 and a cooling chamber outlet 150 through which the cooling fluid may exit the cooling chamber 144 via the first outlet 118. In some embodiments where the scroll device 100 includes the integrated aftercooler 124, the cooling chamber 144 may be configured to cool both the fixed scroll 106 (and more specifically, the involutes of the fixed scroll 106) and the discharge gas in the integrated aftercooler 124.

As shown, the cooling fluid flow path may enter the flexible conduit 138 via the first inlet 116 as represented by arrow 152, flow through the flexible conduit 138 to one or more cooling passageways 154 (shown in FIGS. 7 and 9) as represented by arrow 156, exit the one or more cooling passageways 154 and enter the flexible conduit 140 as represented by arrow 158 (visible in FIG. 5), flow through the flexible conduit 140 and exit the flexible conduit 140 as represented by arrow 160, enter the cooling chamber 144 via the cooling chamber inlet 148 as represented by arrow 161, and exit the cooling chamber 144 via the cooling chamber outlet 150 as represented by arrow 164. It will be appreciated that the cooling fluid flow path may be reversed in some instances. Further, the cooling fluid flow path as shown is an example cooling fluid flow path and the cooling fluid flow path may be defined by any number of cooling chambers, passageways, conduits, inlets, and/or outlets.

Figure 6:
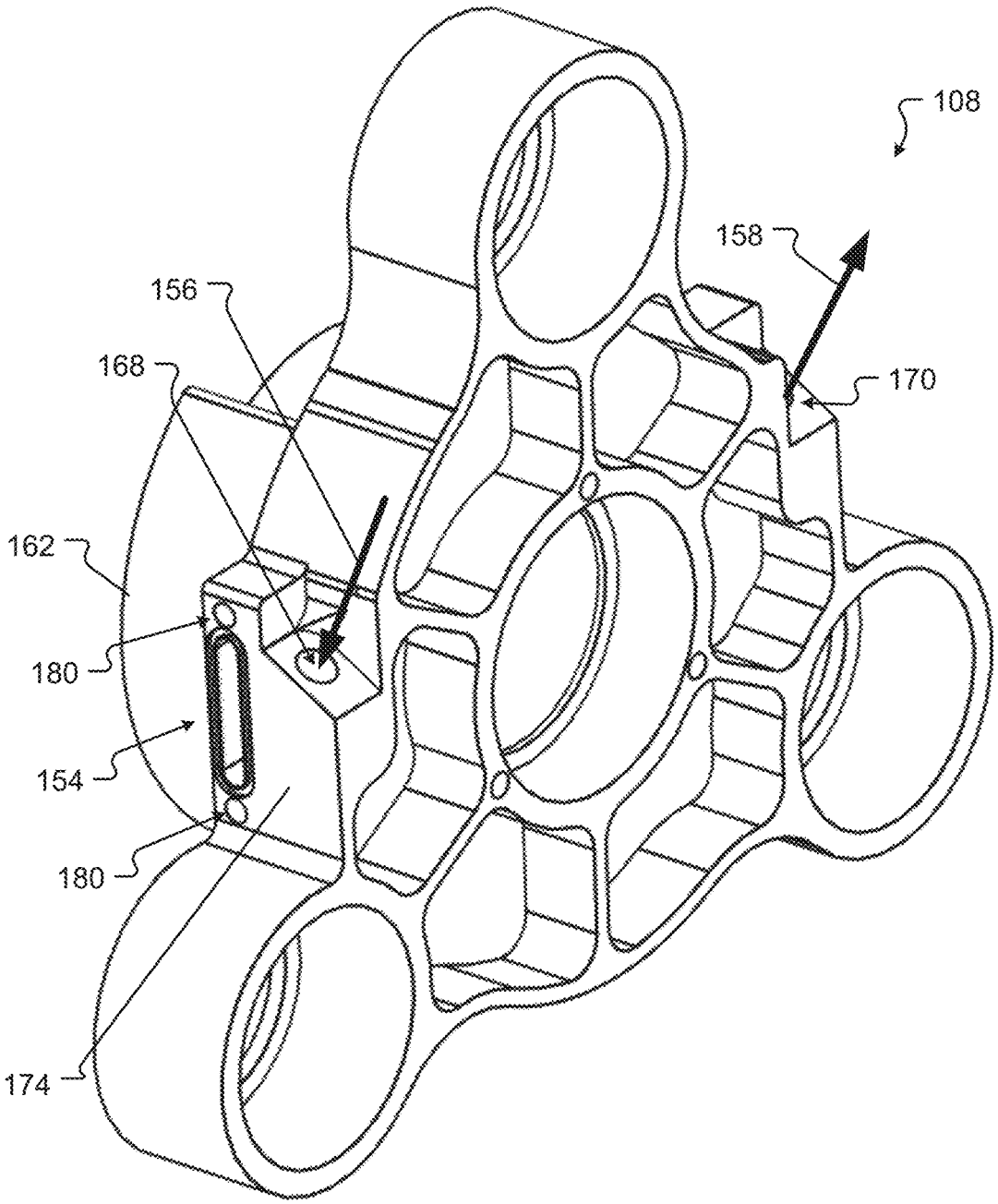
FIG. 6 is a rear perspective view of an orbiting scroll according to at least one embodiment of the present disclosure.
Figure 7:
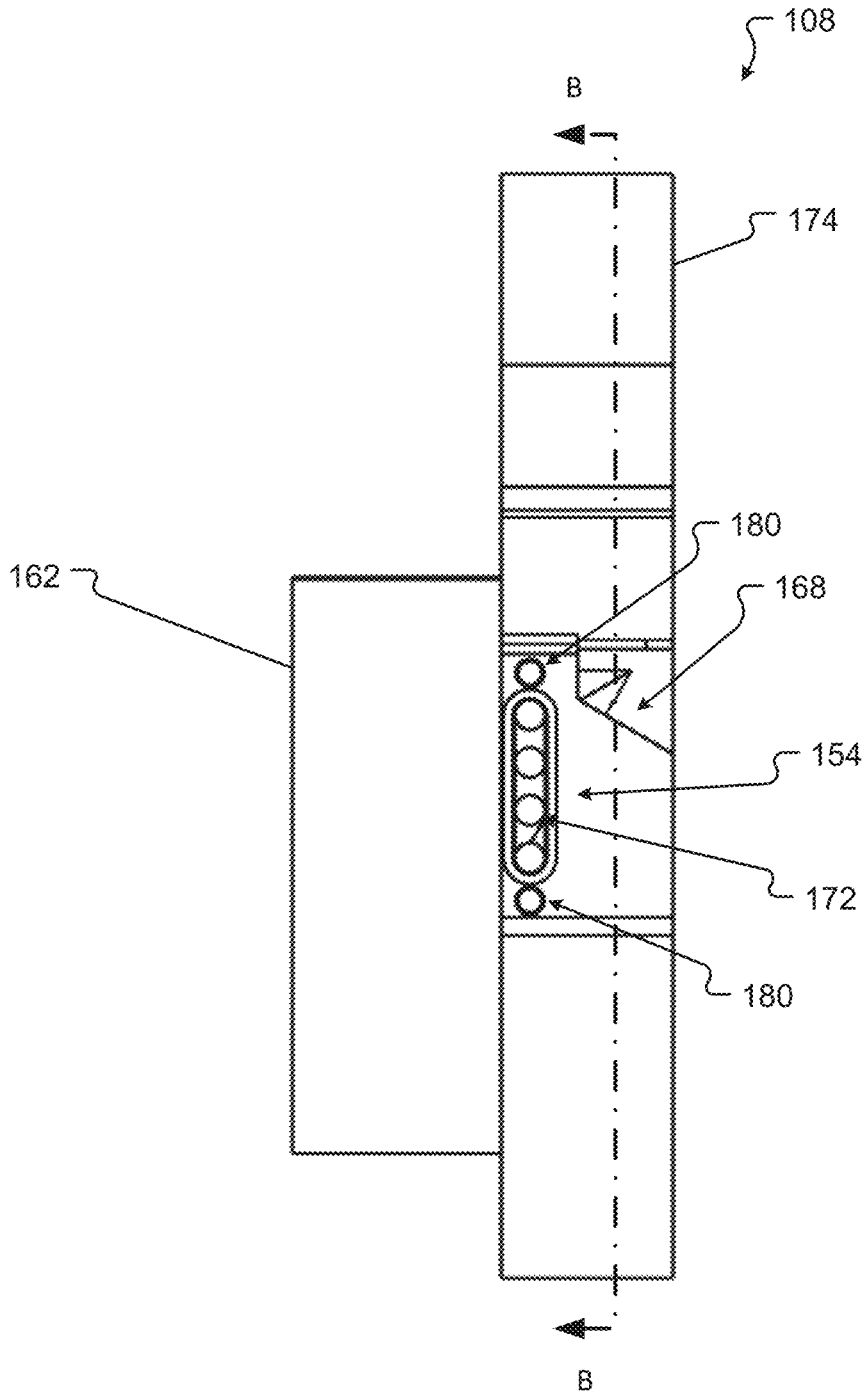
FIG. 7 is a side elevation view of an orbiting scroll according to at least one embodiment of the present disclosure.
Figure 8:
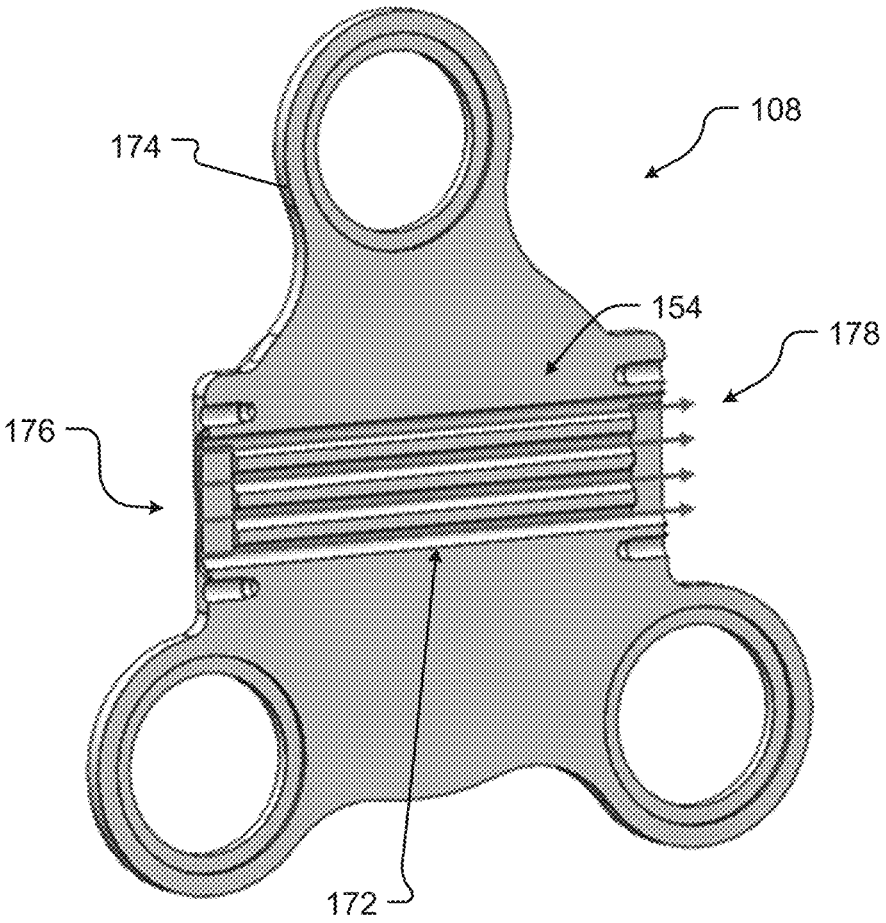
FIG. 8 is a cross-sectional perspective view of an orbiting scroll taken along line B-B shown in FIG. 7 according to at least one embodiment of the present disclosure.

Turning to FIGS. 6-8, the orbiting scroll 108 of the scroll device 100 is shown in isolation for clarity. In FIG. 6, the orbiting scroll 108 is shown in a rear perspective view, in FIG. 7 the orbiting scroll 108 is shown in a side elevation view, and in FIG. 8, the orbiting scroll 108 is shown in a cross-sectional perspective view taken along line B-B shown in FIG. 7. The orbiting scroll 108 includes a cooling fluid inlet 168 configured to receive cooling fluid into one or more cooling passageways 154 (visible in FIG. 9) represented by the arrow 156 and a cooling fluid outlet 170 through which the cooling fluid may exit the one or more cooling passageways 154 represented by the arrow 158. In some embodiments, the positioning of the cooling fluid inlet 168 and the cooling fluid outlet 170 may be reversed. It will be further appreciated that in some embodiments, the cooling fluid inlet 168 and the cooling fluid outlet 170 may be positioned elsewhere on the orbiting scroll 108. In one embodiment, the one or more cooling passageways 154 may comprise cross holes 172 (e.g., shown in FIGS. 7 and 8) formed in the orbiting scroll 108. It will be appreciated that the one or more cooling passageways 154 may comprise passageways of other shapes or sizes. Further, the one or more cooling passageways 154 may comprise one passageway or more than one passageway.

In embodiments where the one or more passageways 154 comprise cross holes 172, the cross holes 172 may correspond to through holes passing through a body 174 of the orbiting scroll 108 and adjacent to involutes of the orbiting scroll 108. In such embodiments, the flexible conduits 138, 140 may be coupled to the cross holes 172. Among other things, this coupling may allow cooling fluid to flow through the cross holes 172 and cool the body 174 of the orbiting scroll 108. The cross holes 172 may be machined into, or otherwise formed in, the orbiting scroll 108. The cross holes 172 receive the cooling fluid from the flexible conduits 138, 140 and may cool the crank bearing and the hottest location on the orbiting scroll 108. The hottest location on the orbiting scroll 108 may be a location where the orbiting scroll 108 and the fixed scroll 106 contact each other, which causes high temperature gas and thermal expansion of the scroll involute.

The cross holes 172 may extend from a first end 176 to a second end 178 of the orbiting scroll 108. As illustrated, for example, in FIGS. 7 and 8, the cross holes 172 comprise four cross holes. It will be appreciated that in some embodiments the cross holes 172 may comprise any number of holes, for example, one cross hole, two cross holes, or more than two cross holes. The cross holes 172 may extend linearly adjacent and in parallel to each other from the first end 176 to the second end 178. It will be appreciated that in some embodiments the cross holes 172 may extend at various angles to each other and/or may be spaced apart, or offset a distance, from one another. Further, two additional holes 180 (e.g., blind holes, through-holes, etc.) may be formed in the body 174 of the orbiting scroll 108 for securing a cover 182 (e.g., as shown in FIG. 5) to the orbiting scroll 108. These additional holes 180 may be disposed outside of an area of the one or more passageways 154. In some embodiments, the additional holes 180 may be in the first end 176 and/or the second end 178 of the body 174. In one embodiment, the additional holes 180 may be configured as through-holes that pass through the body 174 of the orbiting scroll 180. The cover 182 may be, for example, a plate. In some embodiments, the holes 180 may be at least partially tapped (e.g., at the first end 176 and/or the second end 178) to receive screws 184 for securing the cover 182 to the orbiting scroll 108. In other embodiments, the holes 180 may receive pins for securing the cover 182 to the orbiting scroll 108. In still other embodiments, the cover 182 may be coupled to the orbiting scroll 108. A cover 182 may be attached to the first end 176 and/or the second end 178. For example, the arrangement of the cover 182 shown in the rear perspective view of FIG. 5 may be mirrored to illustrate the arrangement of a cover 182 that is attached to the second end 178. In some embodiments, the scroll device 100 may be substantially symmetrical (e.g., having one or more components that are symmetrical, etc.) about a plane that passes through a center of the scroll device 100.

The cross holes 172 can be easily machined with minimal setups using, for example, a horizontal mill. In some examples, the cross holes 172 may be machined, or otherwise formed, in the orbiting scroll 108 such that the cross holes 172 do not break through into a space of the involute of the orbiting scroll 108. In this example, the cooling fluid may be contained within the circuit, or cooling loop, of the scroll device 100. The cross holes 172 may be inexpensive to machine and form, and may also reduce the number of components of a cooling system of the scroll device 100.

It will be appreciated that the fixed scroll 106 and/or the orbiting scroll 108 may have the cooling passageways 154 and/or the cooling chamber 144. For example, the fixed scroll 106 and the orbiting scroll 108 may each comprise one or more cooling passageways. In another example, the orbiting scroll 108 may comprise a cooling chamber and the fixed scroll 106 may comprise one or more cooling passageways 154.

Turning to FIG. 9, a cross-sectional side elevation view of the scroll device 100 taken along line A-A shown in FIG. 1 is shown. As previously described, the scroll device 100 may comprise the integrated aftercooler 124. In such embodiments, the aftercooler plate 126 may at least partially define the cooling chamber 144 of the fixed scroll 106. The aftercooler plate 126 also comprises one or more walls 186 extending from the aftercooler plate 126, which together with the aftercooler cover 128 define an aftercooler chamber 188. With coolant in the cooling chamber 144 formed by the aftercooler plate 126 and the fixed scroll 106, and discharge gas flowing through a discharge gas flow path defined at least in part by the one or more of walls 186 and the aftercooler plate 126, the aftercooler plate 126 is the only thing separating the discharge gas from the coolant. As a result, heat transfer occurs across the aftercooler plate 126, with heat from the hot discharge gas being transferred to and absorbed by the coolant in the cooling chamber 144. The discharge gas therefore cools as it flows through the integrated aftercooler 124, and exits the second outlet 122 at a lower temperature than the temperature at which the discharge gas entered aftercooler chamber 188. U.S. Patent Publication No. 2020/0408201, which is herein incorporated by reference in its entirety, describes an integrated aftercooler 124 in further detail.

To further prevent or reduce the likelihood of coolant leakage from one or more of the cooling chamber 144 or the one or more cooling passageways 154, one or more O-rings or other seals or gaskets may be provided between the fixed scroll 106 and the aftercooler plate 126 and/or between the orbiting scroll 108 and the cooling passageways cover(s) 182.

It will be appreciated that cooling fluid may be delivered to the orbiting scroll 108 and/or the fixed scroll 106 using any combination of delivery mechanisms and/or components. In will also be appreciated that a cooling loop may be open or closed. In other words, in some embodiments, the cooling loop may be self-contained, whereas in other embodiments, the cooling loop may comprise a separate cooling source and/or reservoir for receiving spent cooling fluid. In some embodiments, cooling fluid may be delivered to and from the orbiting scroll 108 using the crankshaft 130. In such embodiments, the scroll device 100 may not include, for example, flexible conduits. In other embodiments, cooling fluid may be delivered to the orbiting scroll 108 using the crankshaft 130 and one or more idler shafts 110, 112, 114. Further background, context, and description of the idler shafts 110, 112, 114 can be found in U.S. Pat. No. 10,865,793, the entirety of which is hereby incorporated by reference for all purposes. In other embodiments, cooling fluid may be delivered to the orbiting scroll 108 using the crankshaft 130 and flexible conduits 138, 140. Further background, context, and description of the flexible conduits 138, 140 can also be found in U.S. Patent Publication No. 2020/0408201, the entirety of which is hereby incorporated by reference herein for all purposes. In still other embodiments, cooling fluid may be delivered to and from the orbiting scroll 108 via the crankshaft 130, one or more idler shafts 110, 112, 114, and/or the flexible conduits 138, 140. In still other embodiments, cooling fluid may be delivered to the orbiting scroll 108 using the crankshaft 130 and may exit the orbiting scroll 108 into a reservoir.

As further shown in FIG. 9, the scroll device 100 may comprise various bearings to support one or more components of the scroll device 100. For example, the scroll device 100 may comprise crankshaft bearings 190 to support the crankshaft 130 and/or idler bearings such as bearings 134, 136 to support one or more of the idler shafts 110, 112, 114.

Figure 10:
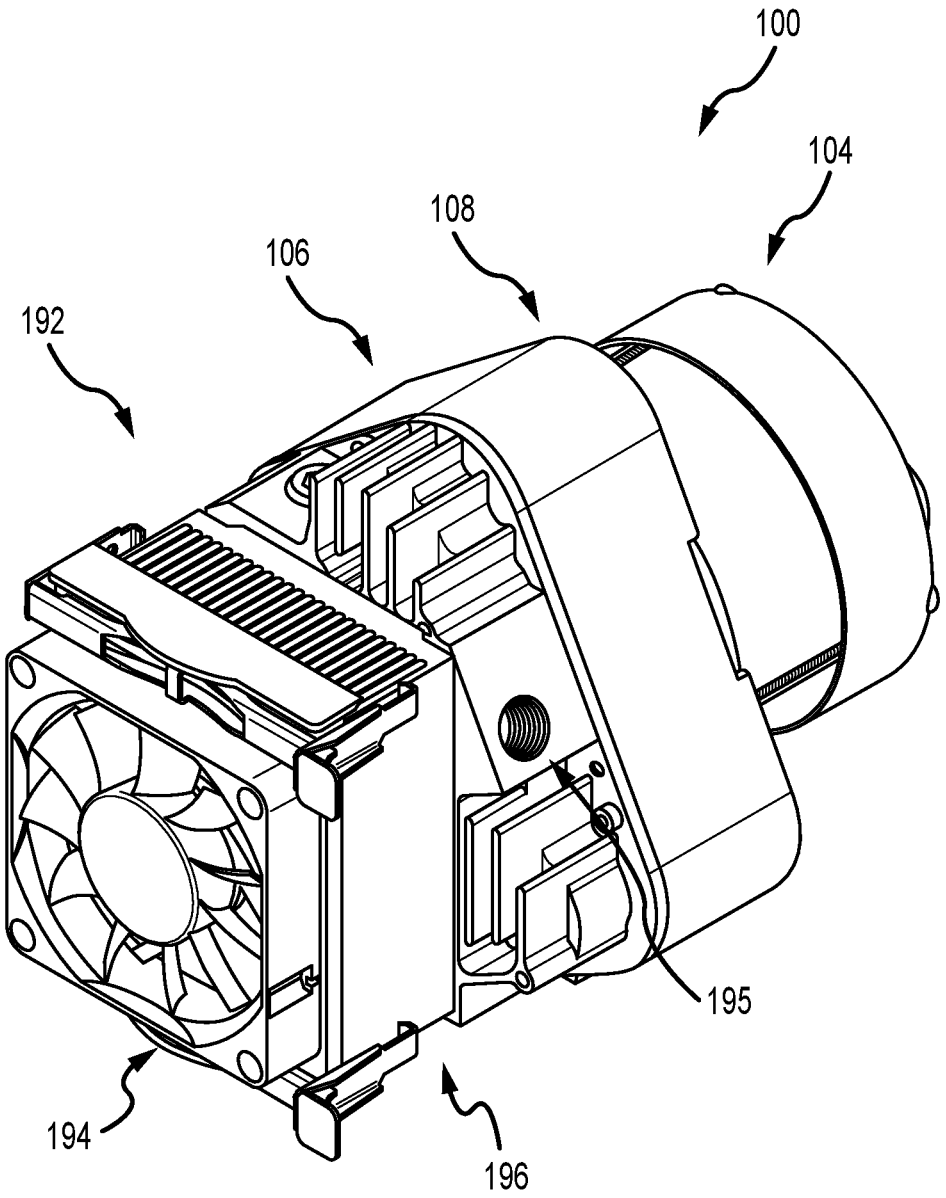
FIG. 10 is a perspective view of a scroll device according to at least one embodiment of the present disclosure.
Figure 11:
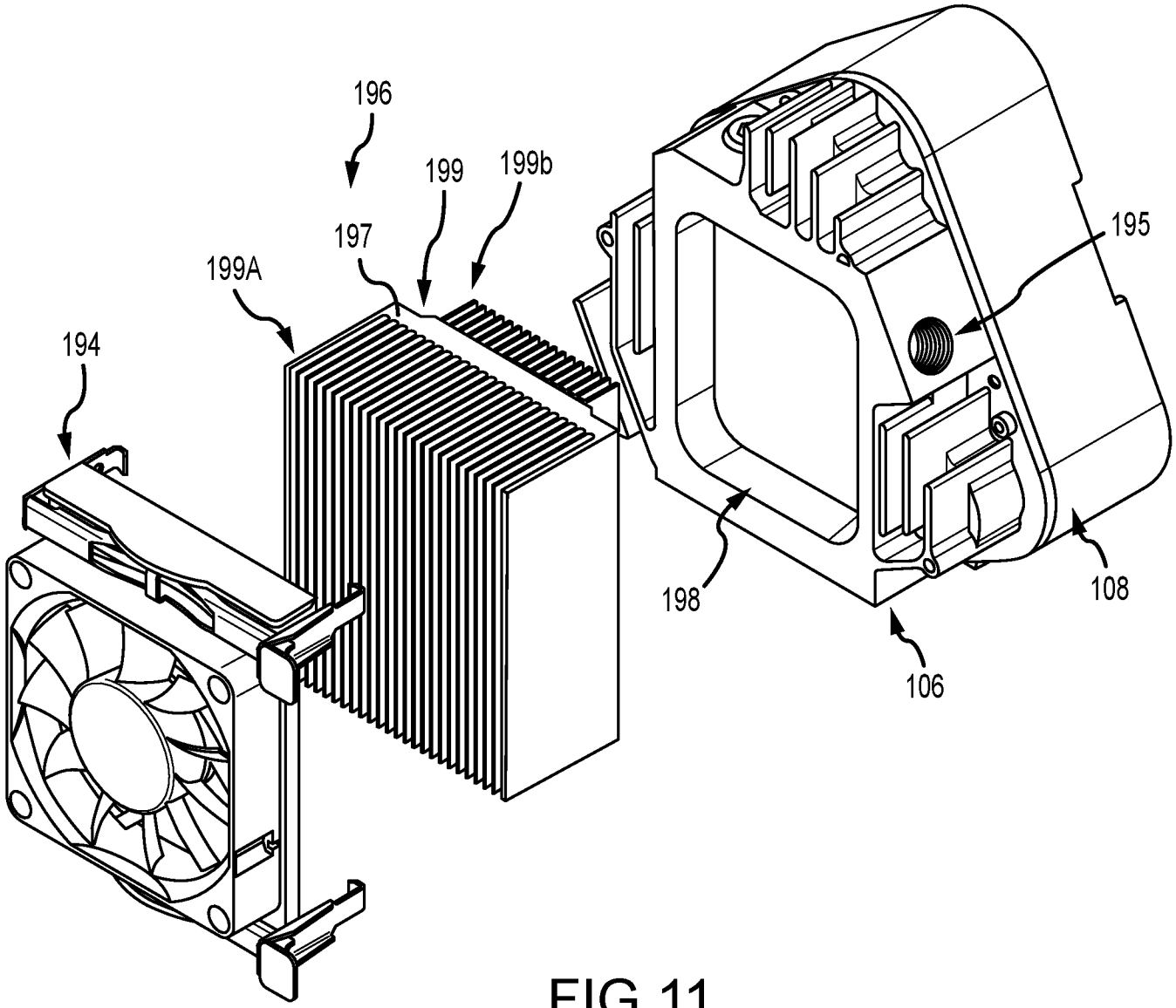
FIG. 11 is an exploded perspective view of a cooling system of a scroll device according to at least one embodiment of the present disclosure.

Turning to FIGS. 10 and 11, a perspective view of the scroll device 100 with a cooling assembly 192 and an exploded perspective view of the cooling assembly 192 are respectively shown. The cooling assembly 192 may comprise a heatsink 196 coupled with a fan 194. The cooling assembly 192 may be mounted directly to the fixed scroll 106 of the scroll device 100 and may be in direct contact with the cooling fluid. In some embodiments, the fixed scroll 106 may comprise a recessed section 198 that acts as a coolant reservoir. The cooling assembly 192 may form an integrated cooling system.

The heatsink 196, as illustrated, comprises fins 199 which may be formed from, for example, aluminum. More specifically, the heatsink 196 comprises a plurality of air fins 199A disposed on one side of a body 197 of the heatsink 196 and a plurality of coolant fins 199B disposed on the other side of the body 197 of the heatsink 196. The heatsink 196 may be fastened, clamped, or otherwise attached to the fixed scroll 106 such that the plurality of coolant fins 199B are disposed, at least partially, in the recessed section 198 (e.g., a coolant reservoir). The body 197 of the heatsink 196 may be sealed against a sealing face of the fixed scroll 106 via a gasket, O-ring, etc. This sealed interface ensures that the cooling fluid remains inside the coolant loop of the integrated cooling system. During operation, the cooling fluid may flow into the recessed section 198 via a first coolant flow port 195 and then flow between and around the plurality of coolant fins 199B disposed therein. The coolant may then flow out of the coolant reservoir via a second coolant flow port (e.g., disposed opposite the first coolant flow port). In one embodiment, the plurality of coolant fins 199B on the back side of the cooling assembly 192 extends into the recessed portion 198, thereby improving heat transfer to the heatsink 196. Stated another way, a conductive thermal path may be provided between the sealed recessed portion 198 (e.g., a coolant reservoir) and the outside environment of the scroll device 100 via the body 197 of the heatsink 196.

Figure 12:
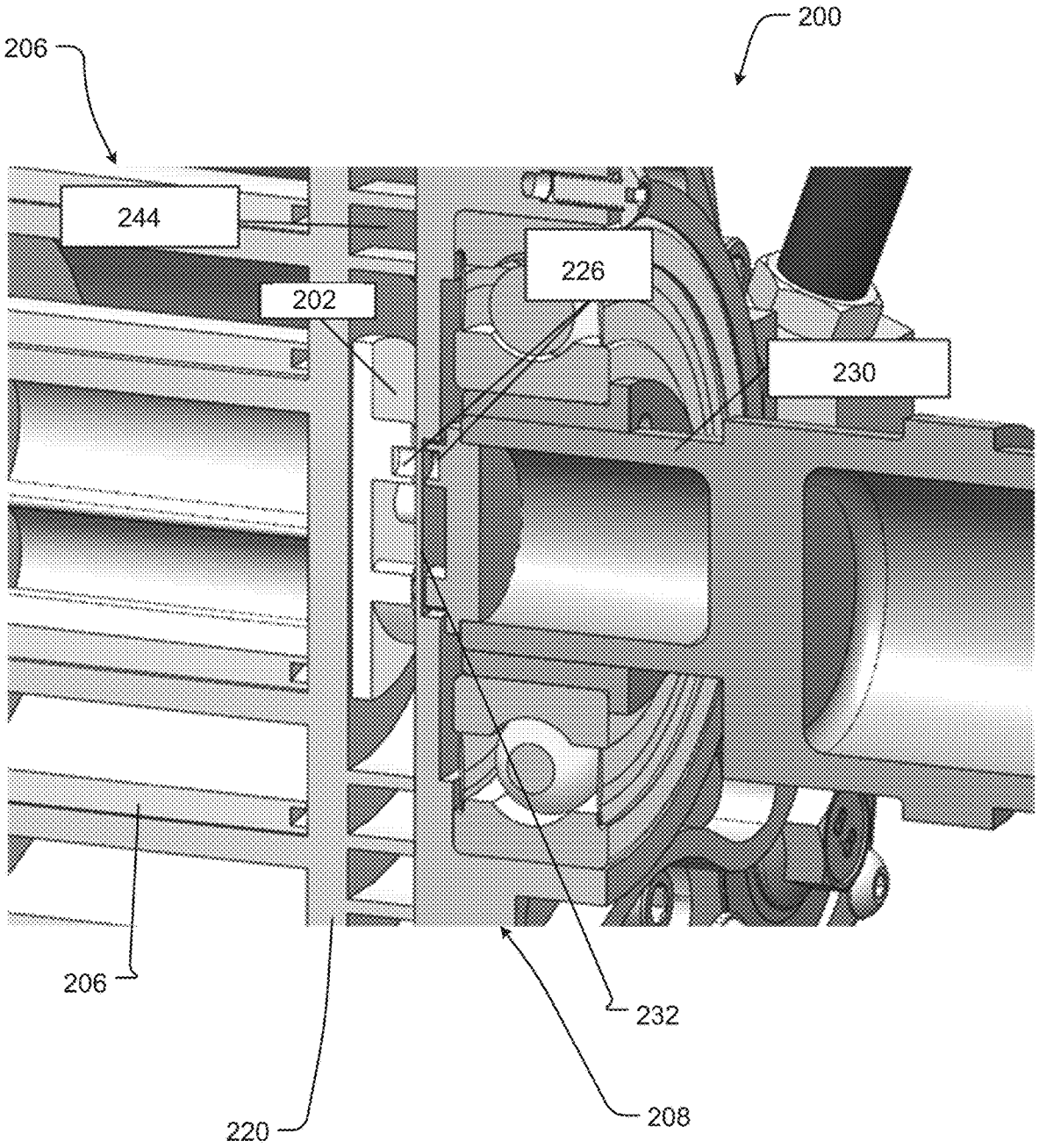
FIG. 12 is a detail perspective view of a coupling of a scroll device according to at least one embodiment of the present disclosure.

Turning to FIG. 12, a detailed cross-sectional view of a scroll device 200 and an impeller 202 are shown. The scroll device 200 may be the same as or similar to the scroll device 100 described above in conjunction with FIGS. 1-11. In some embodiments, an orbiting scroll 208 (which may be the same as or similar to the orbiting scroll 108 of the scroll device 100 described above) of the scroll device 200 may comprise an orbiting scroll cooling chamber 244 enclosed by an orbiting scroll cooling jacket 220. In such embodiments, the scroll device 200 may utilize the impeller 202 inside of the orbiting scroll cooling chamber 244 to circulate coolant throughout the cooling loop. The impeller 202 may use a magnetic coupling 226 between the impeller 202 and the crankshaft 230 to drive the impeller 202 without the use of additional seals. The impeller 202 may be made from a plastic and/or resin material (e.g., polyetheretherketone, polyoxymethylene, etc.) and/or some other lightweight, low friction, material. In one embodiment, the impeller 202 may spin, or rotate, inside the orbiting scroll cooling chamber 244 the magnets 226, which are attached to the crankshaft 230 and magnetically coupled to magnets 226 of the impeller 202, spin on the other side of a thin wall 232 separating the orbiting scroll cooling jacket 220 and the orbiting scroll cooling chamber 244 from the crankshaft 230.

Figure 13:
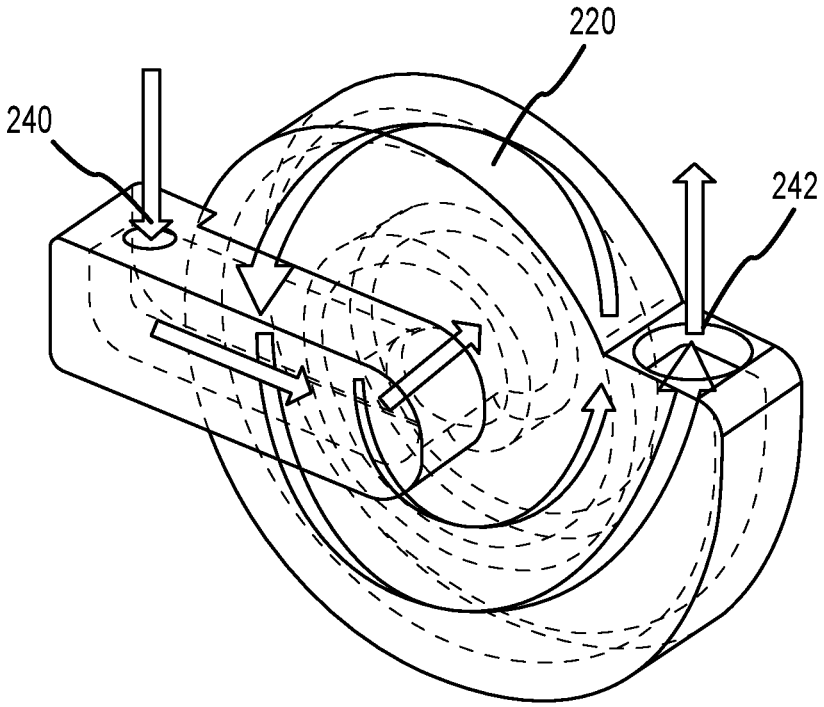
FIG. 13 is a schematic diagram illustrating the arrangement of an orbital scroll jacket that moves fluid using centrifugal forces and vortex flow according to at least one embodiment of the present disclosure.

Additionally or alternatively, the scroll device 200 may utilize the inherent circular motion of the orbiting scroll 208 to create a vortex flow in the orbiting scroll cooling chamber 244. The orbiting scroll cooling jacket 220 may use this vortex flow to propel coolant out of the orbiting scroll 108, and back to a reservoir on a fixed scroll 206 (which may be the same as or similar to the fixed scroll 106 of the scroll device 100 described above) of the scroll device 200. In one embodiment, a check valve may be used to ensure one way flow between a fixed scroll cooling jacket (not shown) and the orbiting scroll cooling jacket 220. As shown in FIG. 13, a schematic diagram illustrates the arrangement of the orbital scroll cooling jacket 220 that moves fluid using centrifugal forces and vortex flow generated by the motion of the orbiting scroll 208 in accordance with embodiments of the present disclosure. In the illustrated embodiment, fluid enters an inlet 240 and the centrifugal forces and vortex flow cause the fluid to exit at an outlet 242.

In some embodiments, a movement of the crankshaft may engender a circular or elliptical orbiting movement of a corresponding part associated with the cooling loop. This orbiting movement may cause the coolant to move throughout the coolant loop integrated cooling system.

Among other things, the arrangements described above (e.g., cooling chambers, cooling passageways, cooling assemblies, etc.) provide a compact integrated cooling system for any scroll device 100, 200 and eliminates the need for large external cooling systems. It will be appreciated that a scroll device may comprise any combination of components described herein. For example, a scroll device may comprise an orbiting scroll with one or more passageways such as the one or more passageways 154 and a cooling assembly such as the cooling assembly 192 coupled to a fixed scroll. In another example, a scroll device may comprise an orbiting scroll with a cooling chamber and an impeller such as the impeller 202 disposed in the cooling chamber to circulate cooling fluid. In such examples, a cooling assembly such as the cooling assembly 192 may be coupled to a fixed scroll and/or the fixed scroll may comprise one or more cooling passageways such as the one or more cooling passageways 154.

Ranges have been discussed and used within the forgoing description. One skilled in the art would understand that any sub-range within the stated range would be suitable, as would any number or value within the broad range, without deviating from the invention. Additionally, where the meaning of the term "about" as used herein would not otherwise be apparent to one of ordinary skill in the art, the term "about" should be interpreted as meaning within plus or minus five percent of the stated value.

Throughout the present disclosure, various embodiments have been disclosed. Components described in connection with one embodiment are the same as or similar to like-numbered components described in connection with another embodiment.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description, for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

Any of the steps, functions, and operations discussed herein can be performed continuously and automatically.

What is claimed is:

1. A scroll device comprising:

a cooling fluid reservoir;

a fixed scroll comprising a first involute;

an orbiting scroll comprising an orbital axis and a body having a thickness defined by a distance measured in an axial direction running parallel to the orbital axis between a first surface of the body and a second surface of the body, a second involute extending from the first surface in the axial direction away from the second surface of the body, and a set of cross holes extending through the body transverse to the orbital axis and between the first surface and the second surface from a first side of the body offset a first transverse distance from the orbital axis to a second side of the body, the orbiting scroll mounted to the fixed scroll via a mechanical coupling, the orbiting scroll configured to orbit relative to the fixed scroll around the orbital axis; and an integrated cooling loop comprising a cooling fluid flow path running from the cooling fluid reservoir to the set of cross holes and back to the cooling fluid reservoir, wherein cooling fluid routes along the cooling fluid flow path.

2. The scroll device of claim 1, wherein the set of cross holes are through-holes extending linearly from the first side of the body through the second side of the body.

3. The scroll device of claim 2, wherein the set of cross holes extend parallel to each other.

4. The scroll device of claim 1, wherein the cooling fluid reservoir is disposed on the fixed scroll.

5. The scroll device of claim 4, further comprising at least one flexible conduit coupled to the cooling fluid reservoir and the set of cross holes, the at least one flexible conduit configured to route the cooling fluid between the cooling fluid reservoir and the set of cross holes.

6. The scroll device of claim 5, further comprising an integrated aftercooler that partially encloses the cooling fluid reservoir, wherein the integrated aftercooler is configured to cool a discharge fluid discharged from the scroll device.

7. The scroll device of claim 5, wherein the set of cross holes comprises four cross holes.

8. The scroll device of claim 5, further comprising a cross hole inlet disposed near the first side and a cross hole outlet disposed near the second side, each of the cross hole inlet and the cross hole outlet in fluid communication with the at least one flexible conduit.

9. The scroll device of claim 1, further comprising a heatsink attached to the fixed scroll and comprising a set of cooling fluid fins disposed on a first side of the heatsink and a set of air fins disposed on a second side of the heatsink opposite the first side of the heatsink, wherein the set of cooling fluid fins extend into the cooling fluid reservoir and in contact with the cooling fluid routing along the cooling fluid flow path, wherein the cooling fluid reservoir is sealed by the first side of the heatsink preventing cooling fluid from reaching the set of air fins, and wherein a heat conduction path runs from the set of cooling fluid fins disposed in the cooling fluid reservoir through the heatsink to the set of air fins disposed external to the cooling fluid reservoir.

10. The scroll device of claim 1, wherein the set of cross holes are disposed completely within the thickness of the body inset between the first surface and the second surface, the set of cross holes defining separate cooling passageways for the cooling fluid flow path that pass through the body of the orbiting scroll from the first side to the second side.

11. A scroll device comprising:

a fixed scroll comprising a first involute and a cooling chamber;

an orbiting scroll comprising an orbital axis and a body having a thickness defined by a distance measured in an axial direction running parallel to the orbital axis between a first surface of the body and a second surface of the body, a second involute extending from the first surface in the axial direction away from the second surface of the body, and one or more passageways extending through the body transverse to the orbital axis and between the first surface and the second surface from a first side of the body offset a first transverse distance from the orbital axis to a second side of the body, the orbiting scroll mounted to the fixed scroll via a mechanical coupling, the orbiting scroll configured to orbit relative to the fixed scroll around the orbital axis; and an integrated cooling loop comprising a cooling fluid flow path running from the cooling chamber to the one or more passageways and back to the cooling chamber, wherein cooling fluid routes along the cooling fluid flow path, wherein the one or more passageways extend from an inlet at the first side of the body to an outlet at the second side of the body.

12. The scroll device of claim 11, wherein the one or more passageways comprises a set of cross holes.

13. The scroll device of claim 12, wherein the set of cross holes are through-holes extending linearly from the first side of the body through the second side of the body.

14. The scroll device of claim 13, wherein the set of cross holes extend parallel to each other.

15. The scroll device of claim 14, wherein the set of cross holes comprises four cross holes.

16. The scroll device of claim 11, further comprising an integrated aftercooler that partially encloses the cooling chamber, wherein the integrated aftercooler is configured to cool a discharge fluid discharged from the scroll device.

17. The scroll device of claim 11, further comprising at least one flexible conduit coupled to the cooling chamber and the one more passageways, the at least one flexible conduit configured to route the cooling fluid between the cooling chamber and the one or more passageways.

18. The scroll device of claim 17, wherein the at least one flexible conduit curves radially around the orbital axis from the first side of the body to the second side of the body.

19. The scroll device of claim 11, further comprising a heatsink attached to the fixed scroll and comprising a set of cooling fluid fins disposed on a first side of the heatsink and a set of air fins disposed on a second side of the heatsink opposite the first side of the heatsink, wherein the set of cooling fluid fins extend into the cooling chamber and in contact with the cooling fluid routing along the cooling fluid flow path, wherein the cooling chamber is sealed by the first side of the heatsink preventing cooling fluid from reaching the set of air fins, and wherein a heat conduction path runs from the set of cooling fluid fins disposed in the cooling fluid chamber through the heatsink to the set of air fins disposed external to the cooling chamber.

20. A scroll device comprising:

a fixed scroll comprising a first involute and a cooling fluid reservoir disposed on a side of the fixed scroll opposite the first involute;

an orbiting scroll comprising a second involute and a set of cross holes extending from a first end to a second end, the orbiting scroll mounted to the fixed scroll via a mechanical coupling, the orbiting scroll configured to orbit relative to the fixed scroll around an orbital axis;

an integrated cooling loop comprising a cooling fluid flow path running from the cooling fluid reservoir to the set of cross holes and back to the cooling fluid reservoir, wherein cooling fluid routes along the cooling fluid flow path; and a heatsink attached to the fixed scroll and comprising a set of cooling fluid fins disposed on a first side of the heatsink and a set of air fins disposed on a second side of the heatsink opposite the first side of the heatsink, wherein the set of cooling fluid fins extend into the cooling fluid reservoir and in contact with the cooling fluid routing along the cooling fluid flow path, wherein the cooling fluid reservoir is sealed by the first side of the heatsink preventing cooling fluid from reaching the set of air fins, and wherein a heat conduction path runs from the set of cooling fluid fins disposed in the cooling fluid reservoir through the heatsink to the set of air fins disposed external to the cooling fluid reservoir.

* * * * *